United States Patent [19]

Haynes

[11] 4,239,013

[45] Dec. 16, 1980

[54] PROPELLING MEANS

[76] Inventor: Hendrick W. Haynes, P.O. Box 66152, Seattle, Wash. 98166

[21] Appl. No.: 844,215

[22] Filed: Oct. 21, 1977

Related U.S. Application Data

[63] Continuation-in-part of Ser. No. 691,448, Jun. 1, 1976, abandoned.

[51] Int. Cl.[3] ..... B63H 21/00

[52] U.S. Cl. ..... 440/40; 74/484 R; 416/179; 248/621; 440/89; 440/111; 440/113

[58] Field of Search ..... 115/12 R, 14, 15, 16, 115/17, 34 R, 70, 73, 75; 114/144 R, 151; 74/430; 181/36 B, 43, 51; 60/317, 320, 321, 221, 222; 416/179, 181; 248/3, 9, 21, 22, 621, 562, 576, 603, 609, 613, 619, 640

[56] References Cited

U.S. PATENT DOCUMENTS

| | | | |
|---|---|---|---|
| 401,179 | 4/1889 | Lea | 248/621 |
| 1,694,758 | 12/1928 | Summers et al. | 248/621 |
| 1,975,274 | 10/1934 | Hollander et al. | 416/179 |
| 2,215,743 | 9/1940 | Saurer | 248/9 |
| 3,082,732 | 3/1963 | Stallman | 115/16 |
| 3,116,602 | 1/1964 | Dahle | 115/12 R |
| 3,206,836 | 9/1965 | Schlussler | 115/73 |
| 3,240,179 | 3/1966 | Van Ranst | 115/75 |
| 3,641,964 | 2/1972 | Lee | 115/12 R |
| 3,934,538 | 1/1976 | Canazzi | 115/12 R |

FOREIGN PATENT DOCUMENTS

| | | | |
|---|---|---|---|
| 1195622 | 9/1962 | Fed. Rep. of Germany | 115/12 R |
| 1192127 | 10/1959 | France | 115/15 |
| 1381494 | 11/1964 | France | 115/12 R |

*Primary Examiner*—Trygve M. Blix
*Assistant Examiner*—Jesùs D. Sotelo

[57] ABSTRACT

This invention is directed mainly to a propelling apparatus and a control for said propelling apparatus for use with a boat. This invention can be used with a small boat for pleasure and also for fishing. The propelling apparatus comprises a pump in the form of a propeller and a motor for driving the impeller. Also, there is a novel heat exchanger arrangement and a novel mounting device for support of the motor in a driving relationship with the propeller. Further, there is a novel heat exchanger and muffler combination for the exhaust gases from the motor.

21 Claims, 63 Drawing Figures

252
226
222

436
554
446
556
426
420

5
5
98
60
72
278
210
214
216
208
144
54
158
94
146
52
92
142
154
96

222
262
264
206
54
260
256
250
6
258
226
220
212
210
6
218
252

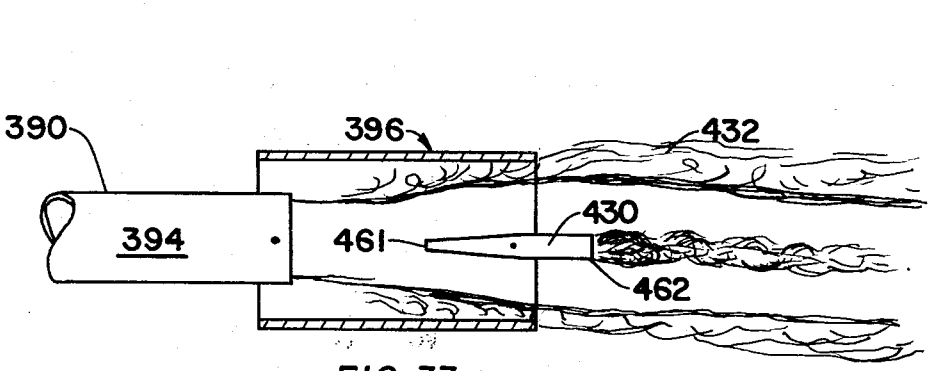
FIG. 33
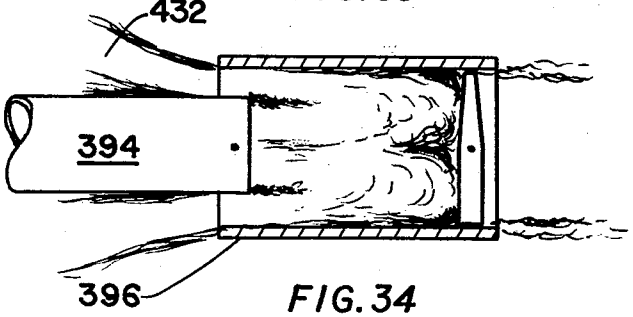
FIG. 34
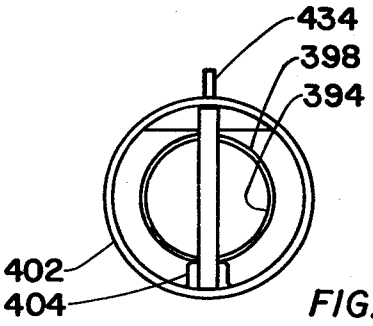
FIG. 37
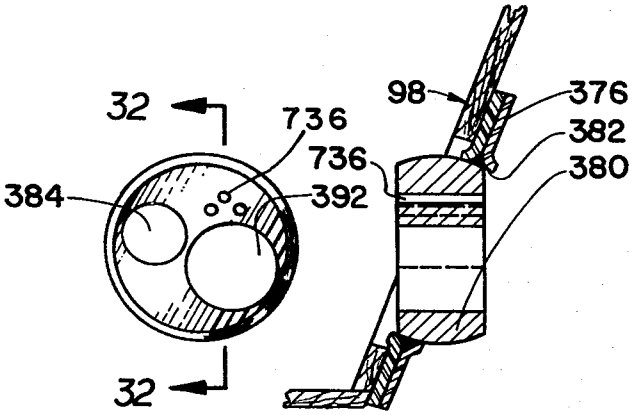
FIG. 32
FIG. 31
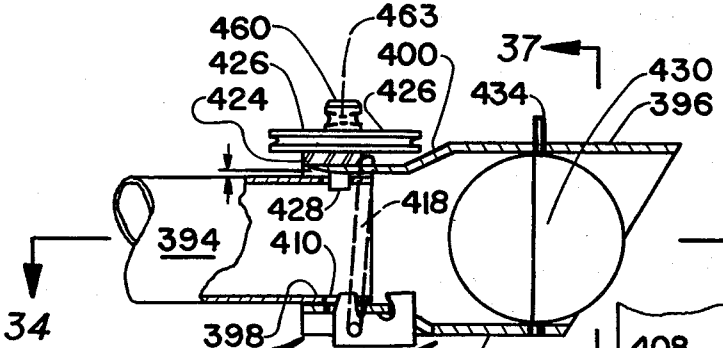
FIG. 35
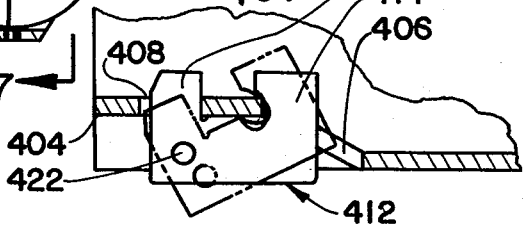
FIG. 36

98
692
698
702
700
92
156
706
694

704
708
712
700
718
716
698
714
710
706
702
712
156

692
690
694
696
156

150
148
720
728
730
722
64
62
62
60
63
52
724
726

162
160
150
148

PROPELLING MEANS

This is a continuation-in-part of application Ser. No. 691,448 filed June 1, 1976, now abandoned.

BACKGROUND OF THE INVENTION

Many people enjoy using small boats for pleasure cruising on lakes, rivers, shallow water and also enjoy using the small boats for fishing and other recreational activities.

Generally, a small boat is powered by an outboard motor, an inboard/outboard, an inboard type system, or/and an axial flow marine jet. These units have used considerable space because of their design, and as a result of their bulk and weight they seriously inhibit the use of the boat. Further, these systems are expensive and often times difficult to maintain, and because of their complexity in the number of parts and the manner in which they are assembled, many parts must be kept by dealers and service personnel in order to adequately service their customers. And, normally, these systems are noisy and highly susceptible to breakage when encountering a foreign object.

Also, for experience, I know that I have derived considerable pleasure and enjoyment from using a small boat for fishing and recreational purposes and know from talking with other people that they have derived similar pleasure. With this background, I have made the following described invention so that other people can afford a propelling means for a small boat and also receive similar pleasures to the pleasures I have received.

GENERAL DESCRIPTION OF THE INVENTION

The propelling means of this invention is for use with a small boat and can be mounted or associated with the bottom of the small boat. There is a housing for a pump or an impeller. A motor can be mounted on the housing for the impeller and can be readily attached to the drive mechanism for the impeller and also can be readily detached from the drive mechanism for the impeller. Further, the propelling means includes a heat exchanger, which may be a part of the impeller housing, for the cooling liquid for the motor and also for the lubricating oil from the motor.

The impeller is driven by the motor and the impeller forces a liquid, such as water, from the housing. This liquid forced from the housing can be used as a propelling means for propelling the boat. The direction of flow of the liquid from the housing and the impeller can be controlled so as to steer the boat in a desired course and manner.

THE OBJECTS AND THE ADVANTAGES

One of the objects of this invention is to provide a compact propelling means for a small boat which is, in the main, out of the way for people in the small boat. The propelling means fits with the bottom of the boat so as to be in the lower part of the boat or underneath the boat and therefore out of the way for the occupants of the boat; this propelling means has a novel heat exchanger and muffler arrangement so as to muffle the noise from the motor; further, this propelling means is so designed and constructed that the motor can be, readily, removed from the impeller; in addition, there is a novel heat exchanger arrangement for cooling a coolant from the motor and, also, for cooling the lubricating oil from the motor, which heat exchanger is part of the housing for the pump or impeller for the boat. An additional and important object of this invention is that it be inexpensive to manufacture, inexpensive to maintain, and can be readily repaired, when necessary; an additional feature of this invention is the ready removal capability of the lock which locks the motor to the housing for the impeller so that the motor may be removed from the housing; an additional feature of this invention is the inexpensive drive connection between the output drive shaft to the motor and the input drive shaft to the impeller or pump; another advantage of this invention is the handy reverse mechanism for reversing the direction of travel of the boat; a further object of this invention is an inexpensive seal means for the drive shaft for the impeller so as to lessen the possibility of water or liquid flowing around the drive shaft; and, another advantage of this invention is a unitary control means for controlling the speed of the boat and also for the steering of the boat and the direction of travel of the boat.

These and other important objects and advantages of the invention will be more particularly brought forth upon reference to the detailed description of the invention, the claims, and the accompanying drawings.

THE DRAWINGS

Figure 1:
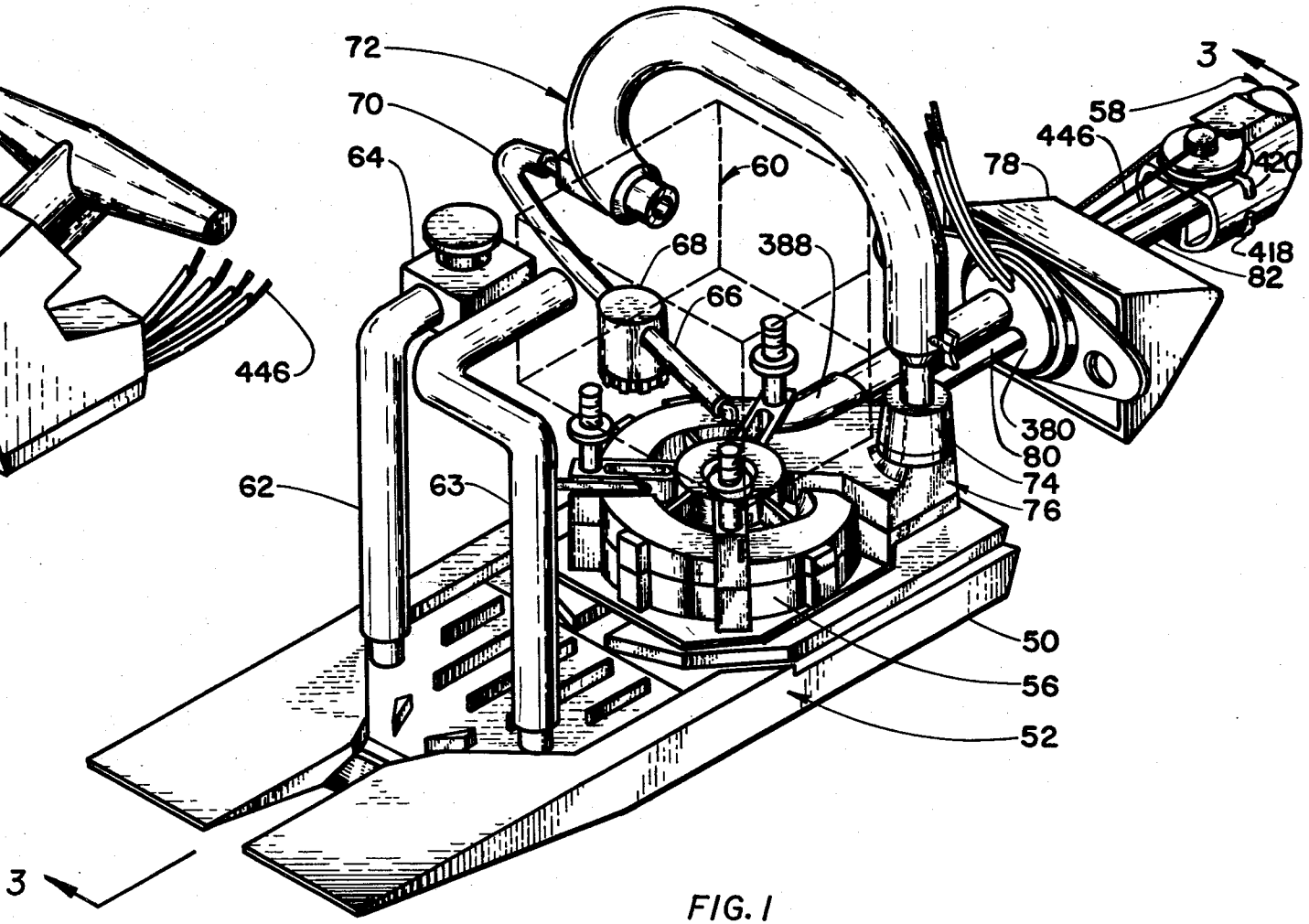
FIG. 1 is an isometric view of the propulsion system in its entirety, less the motor.
Figures 3, 4, 5, 6:
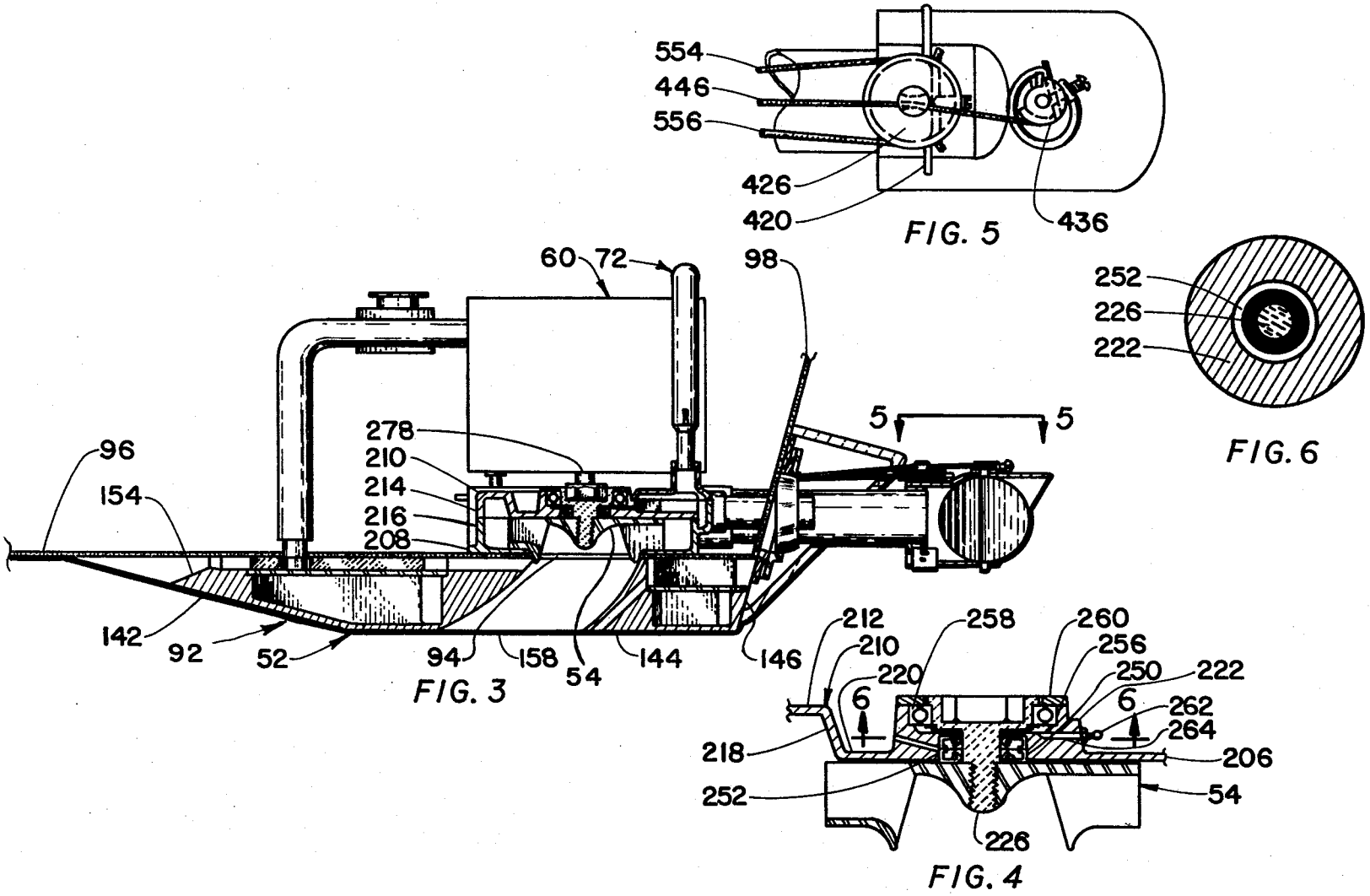
Figures 7, 8, 9, 10:
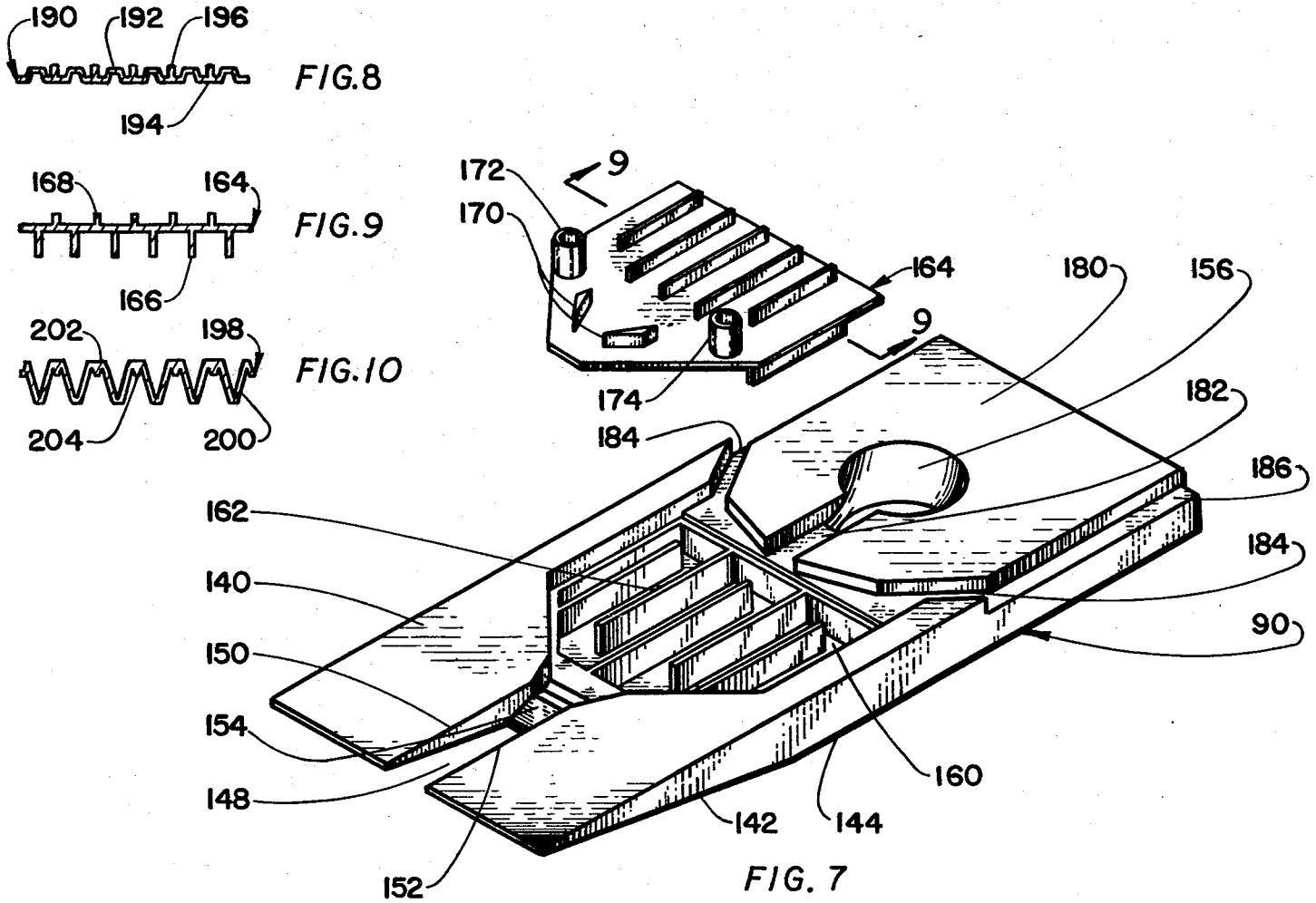
Figure 11:
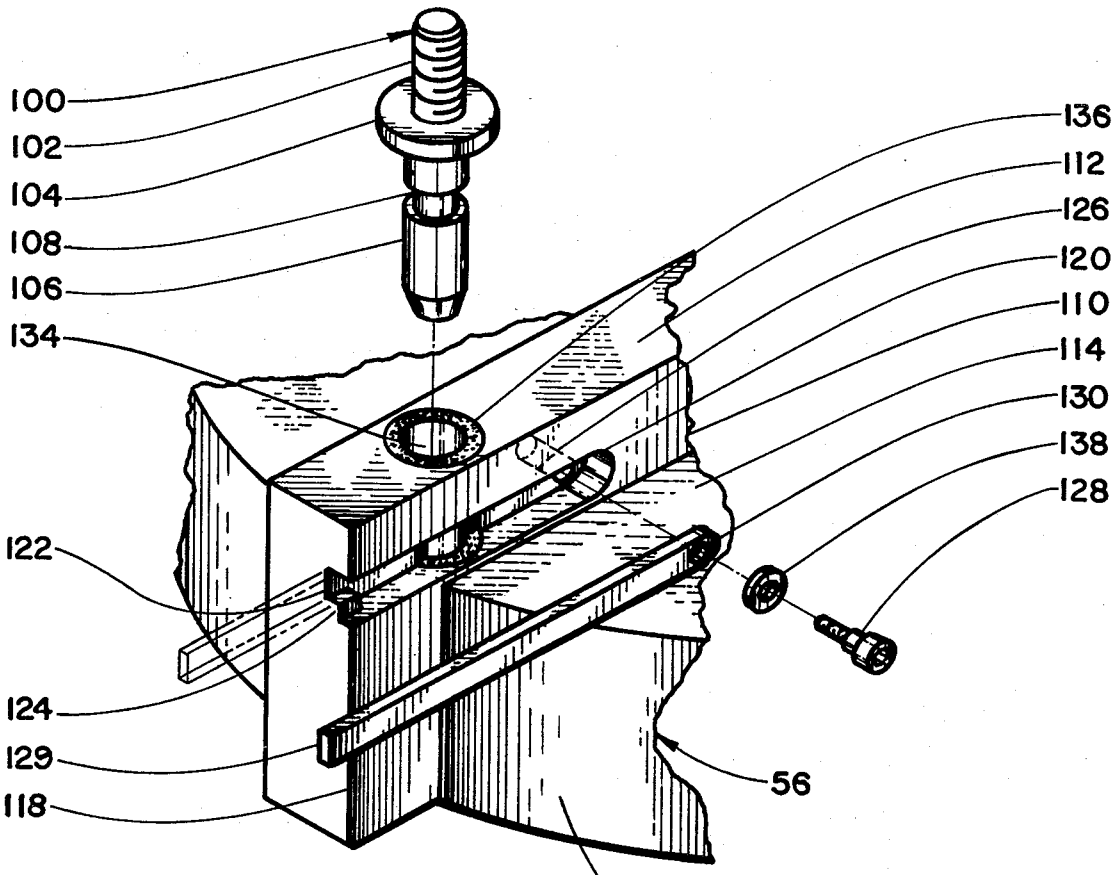
Figure 14:
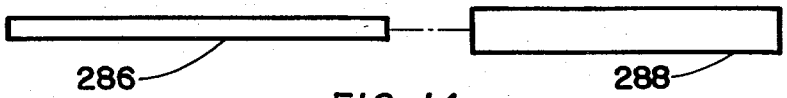
Figure 15:
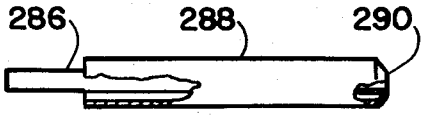
Figure 16:
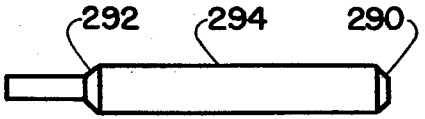
Figure 17:
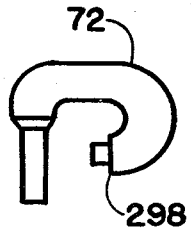
Figure 12:
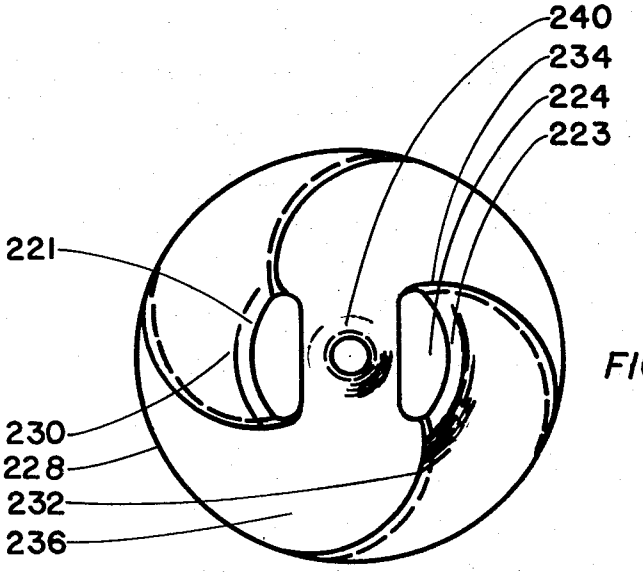
Figure 13:
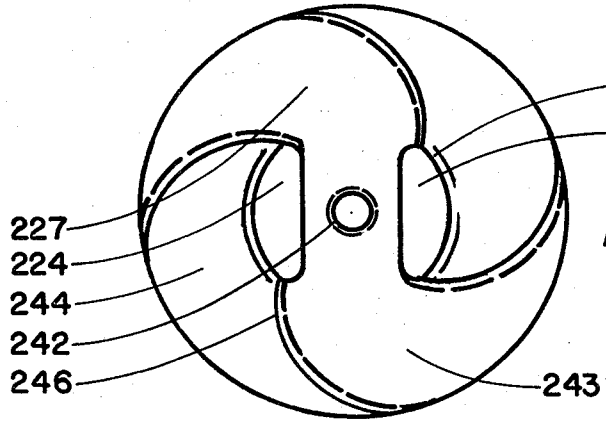
Figure 21:
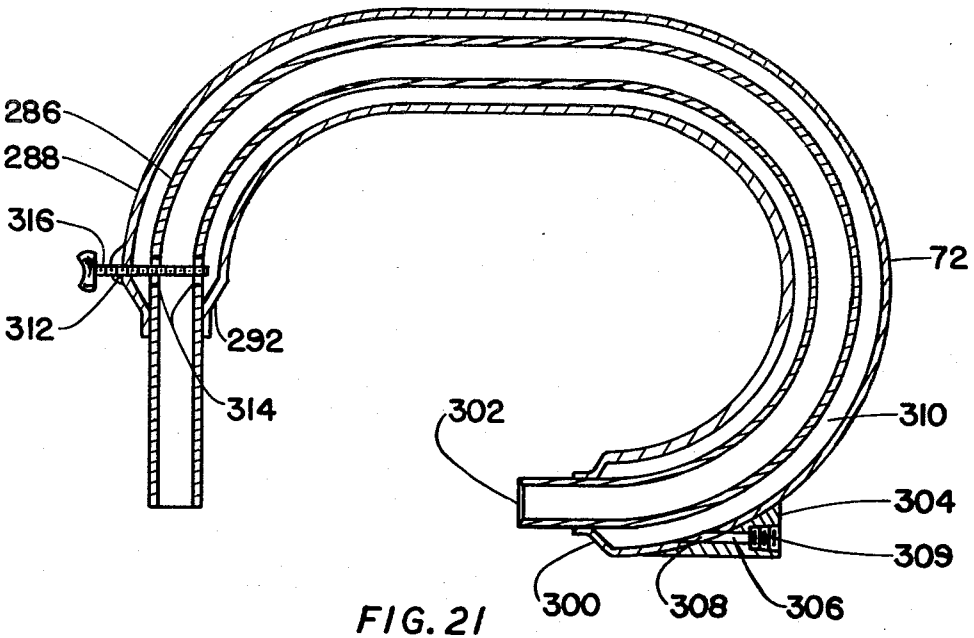
Figure 22:
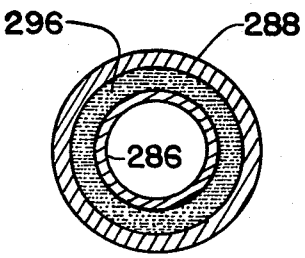
Figure 18:
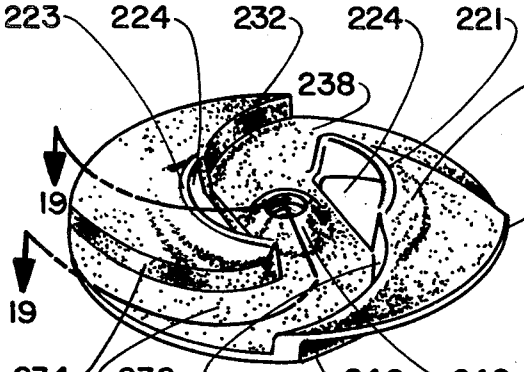
Figure 19:
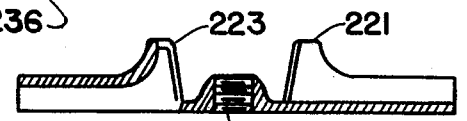
Figure 20:
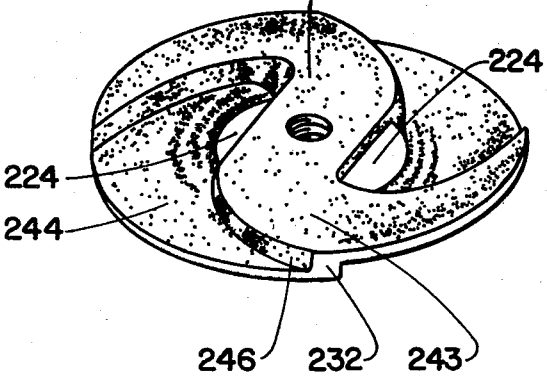
Figure 24:
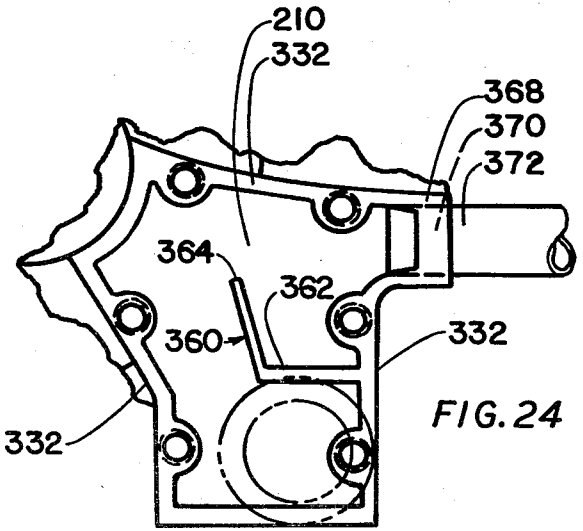
Figure 23:
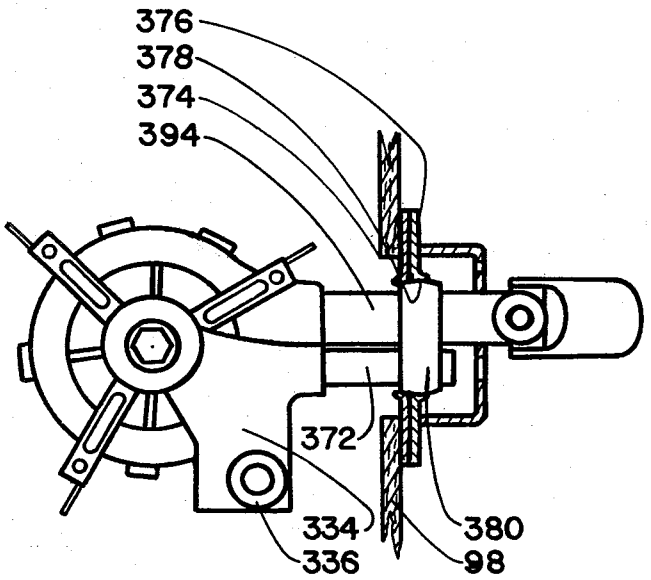
Figure 25:
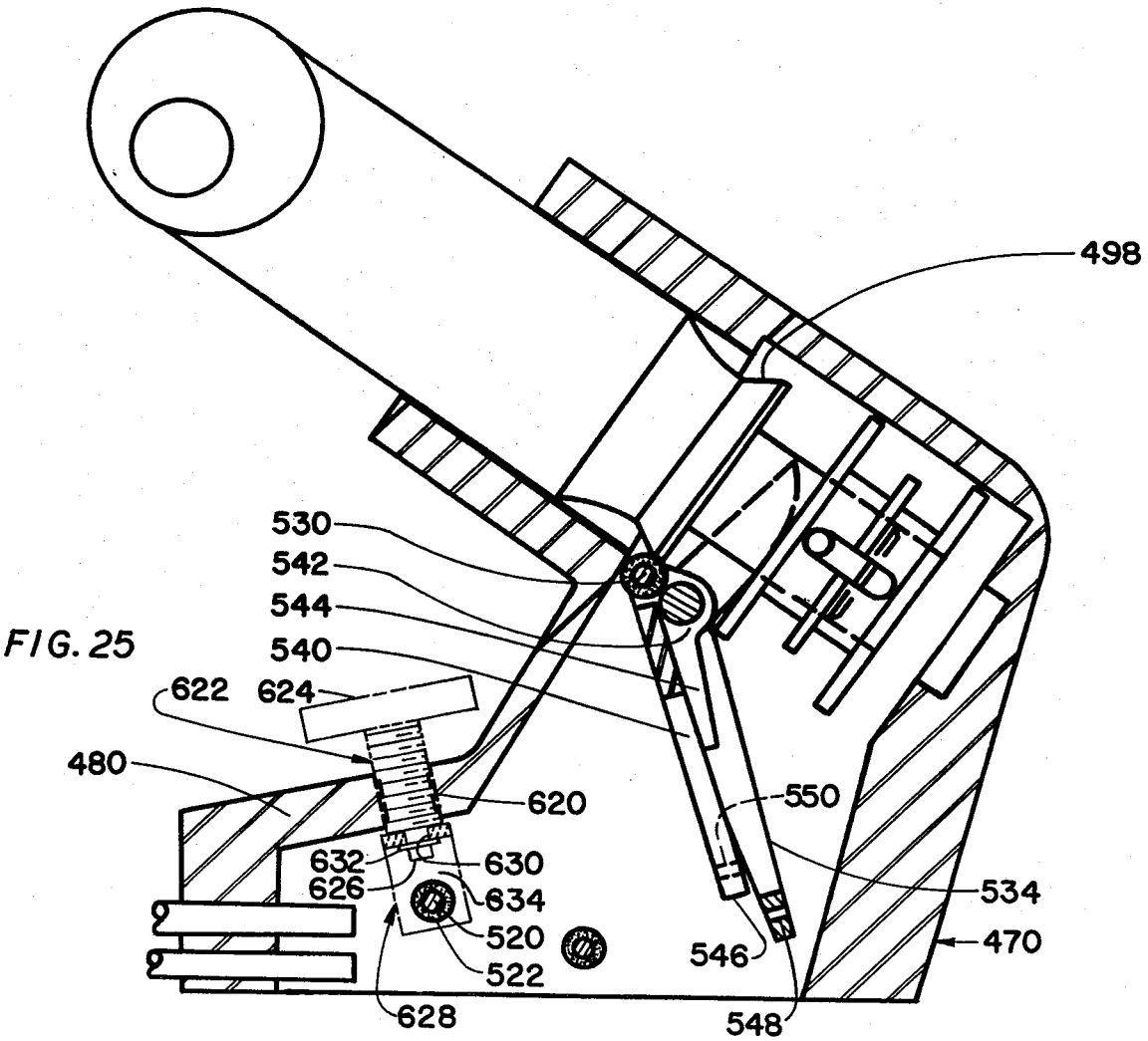
Figure 27:
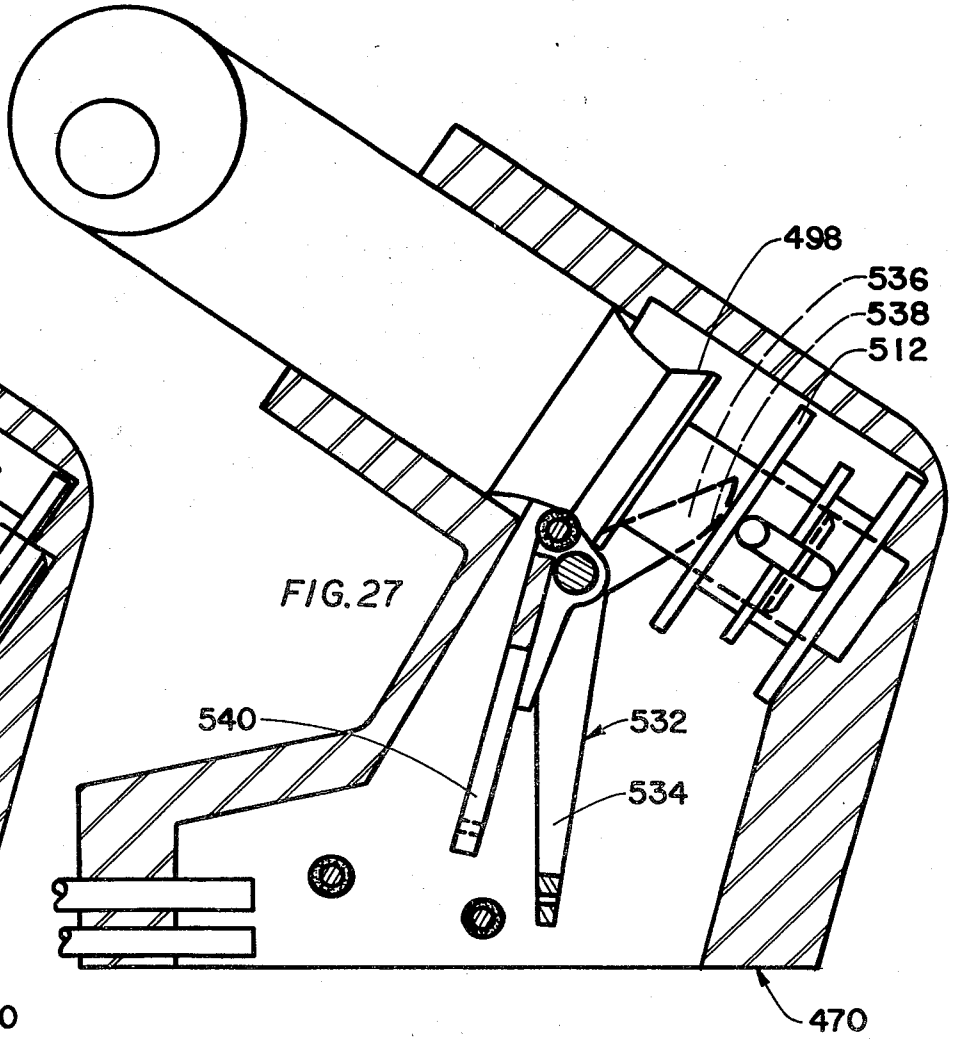
Figure 26:
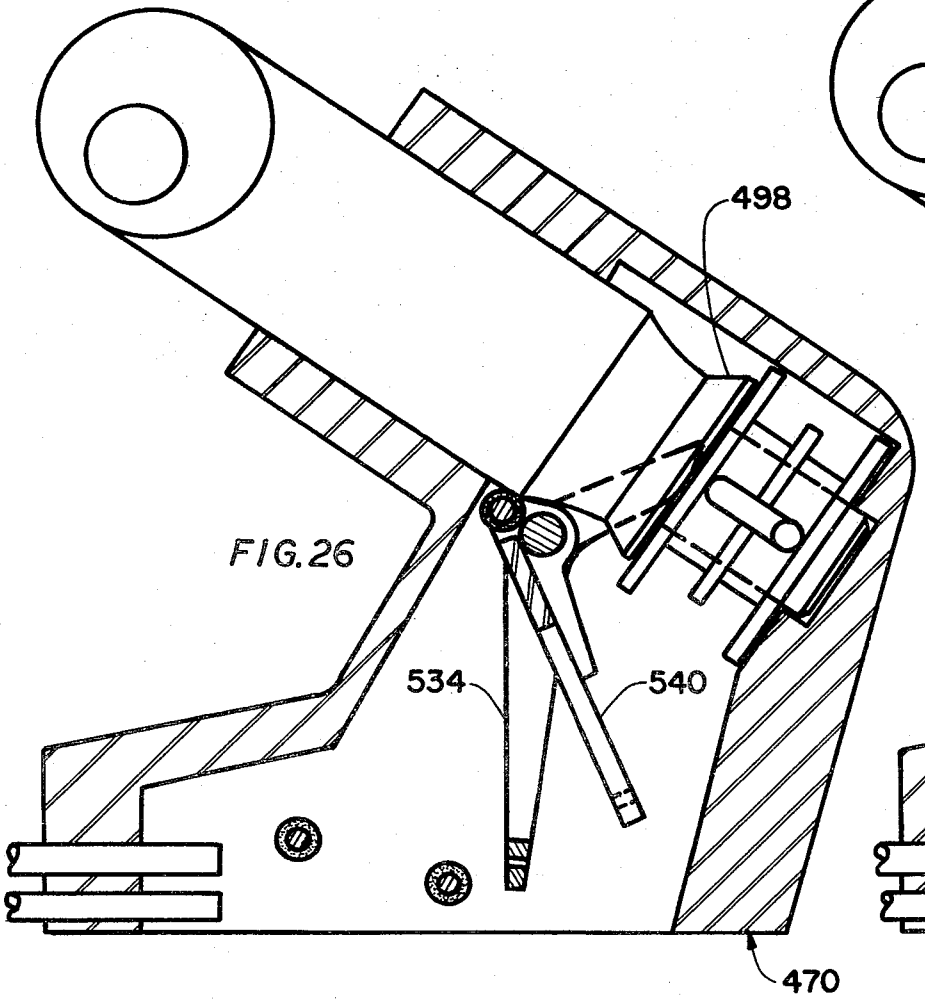
Figure 28:
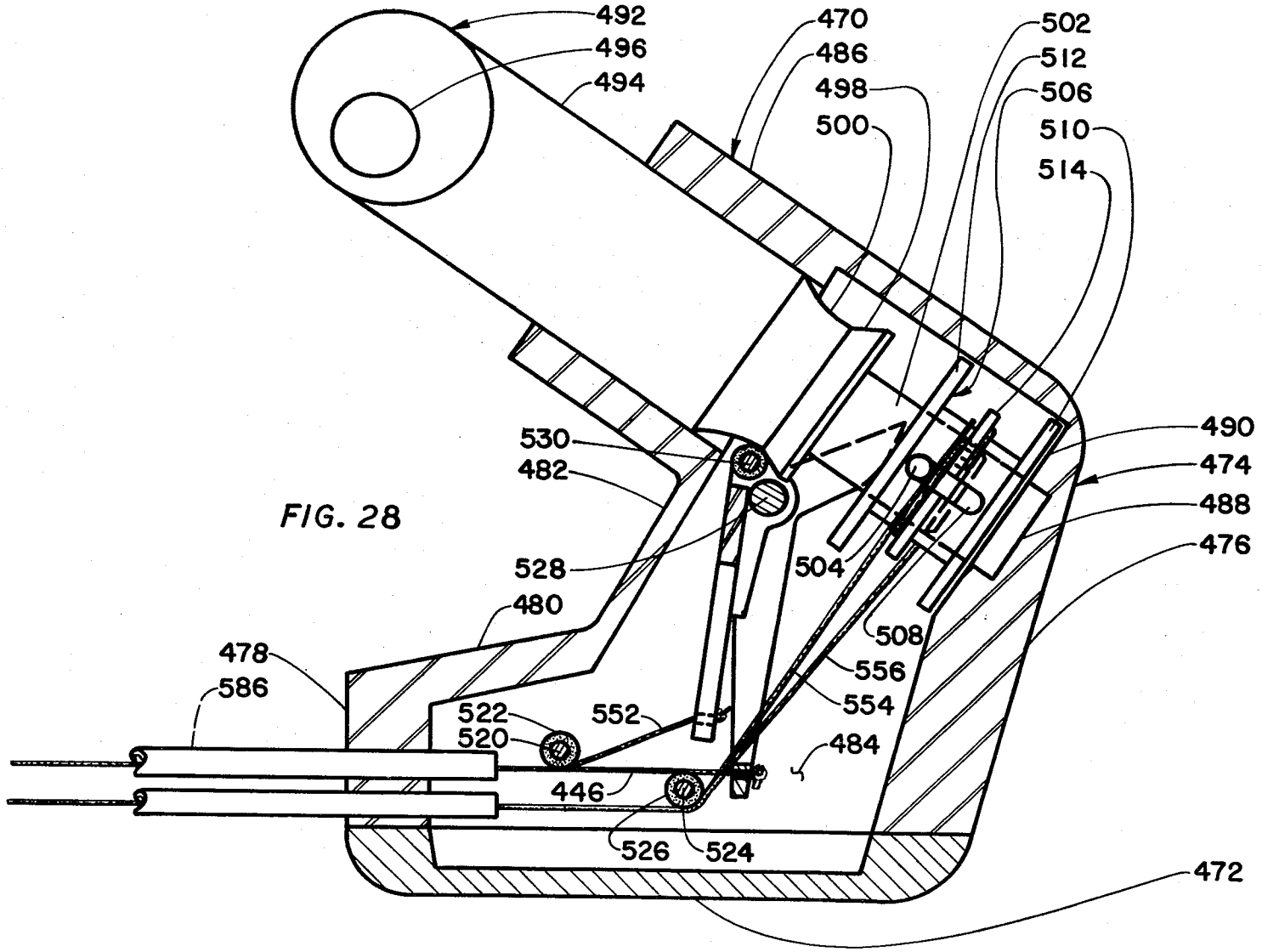
Figure 30:
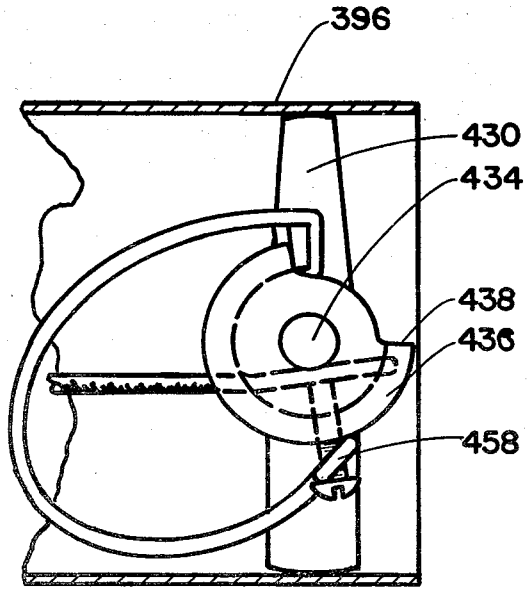
Figure 29:
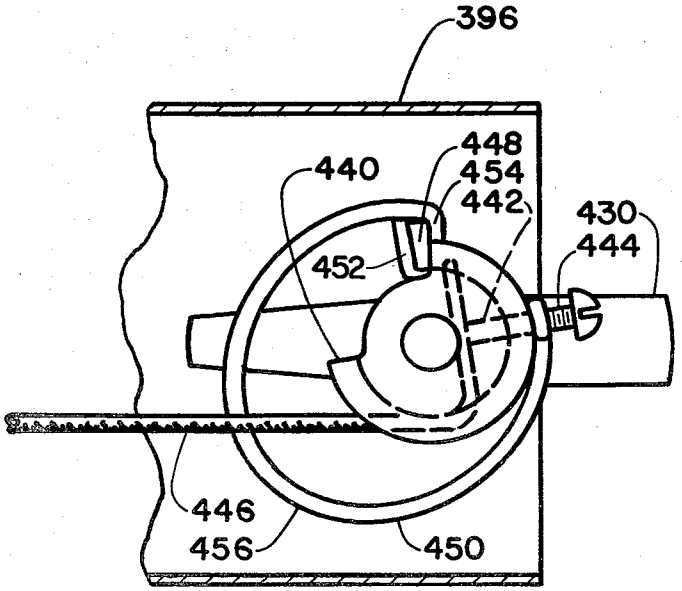
Figure 38:
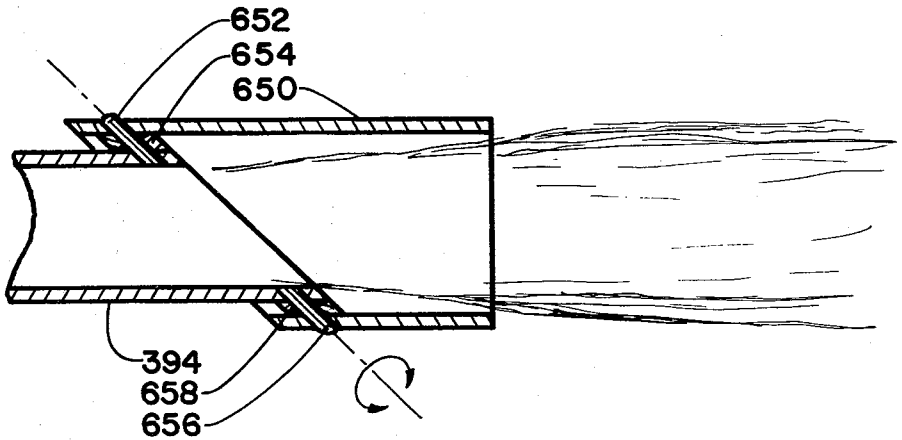
Figure 39:
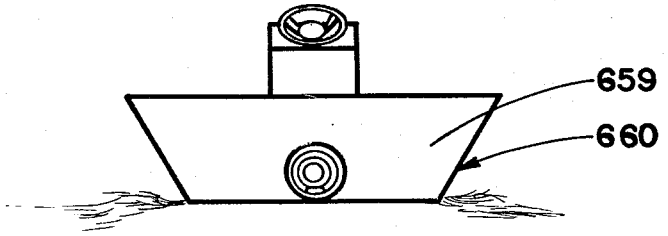
Figure 40:
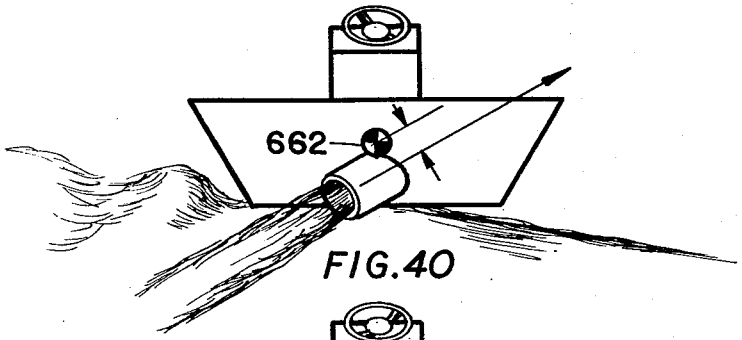
Figure 41:
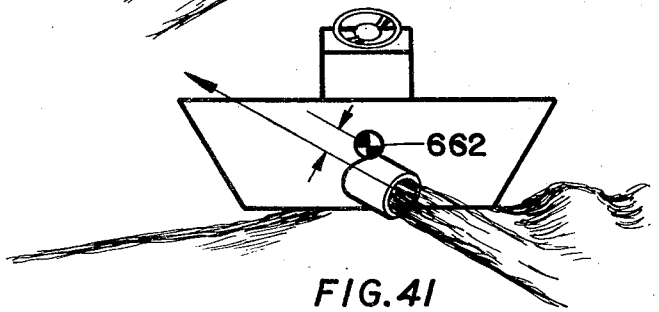
Figure 42:
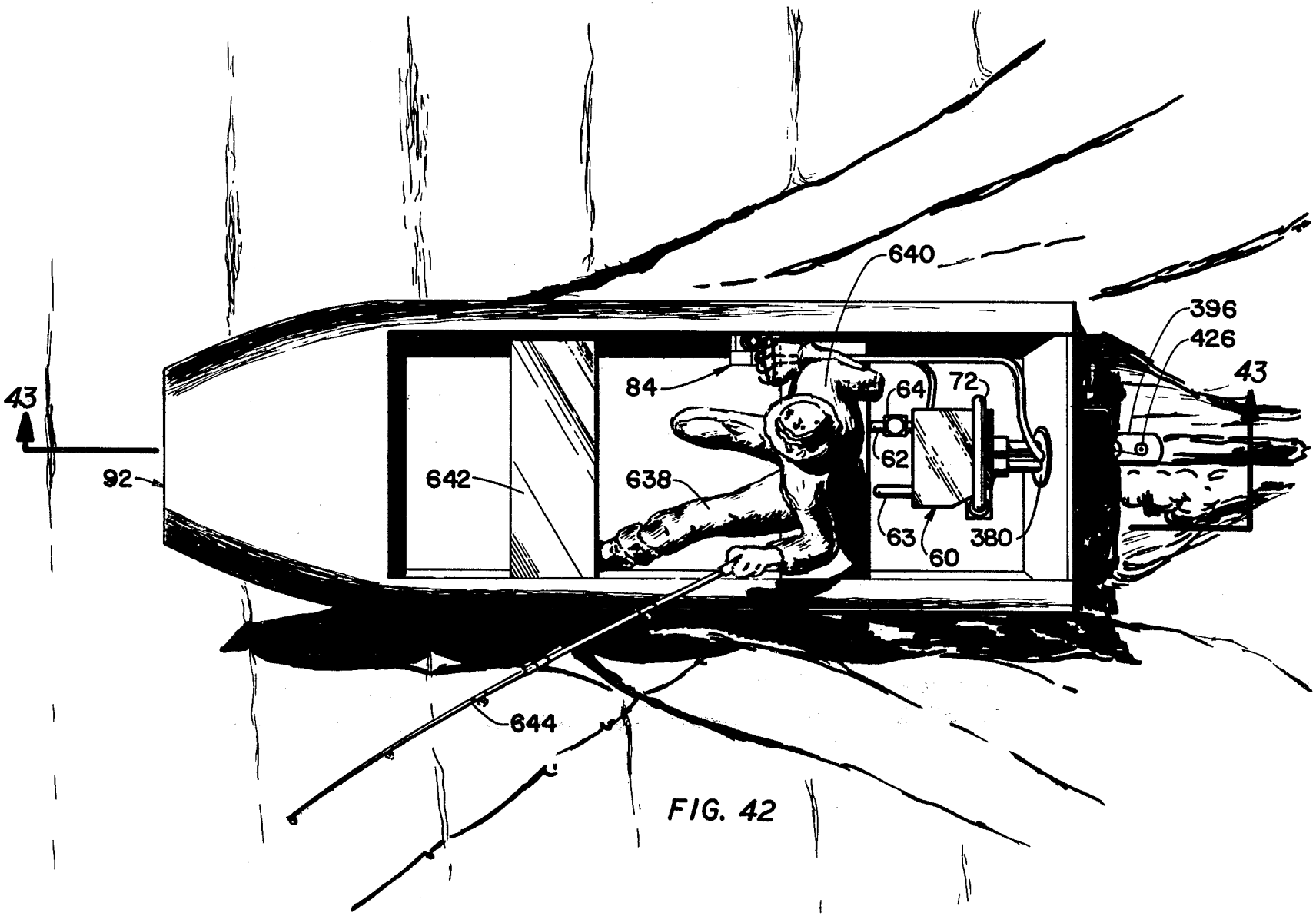
Figure 43:
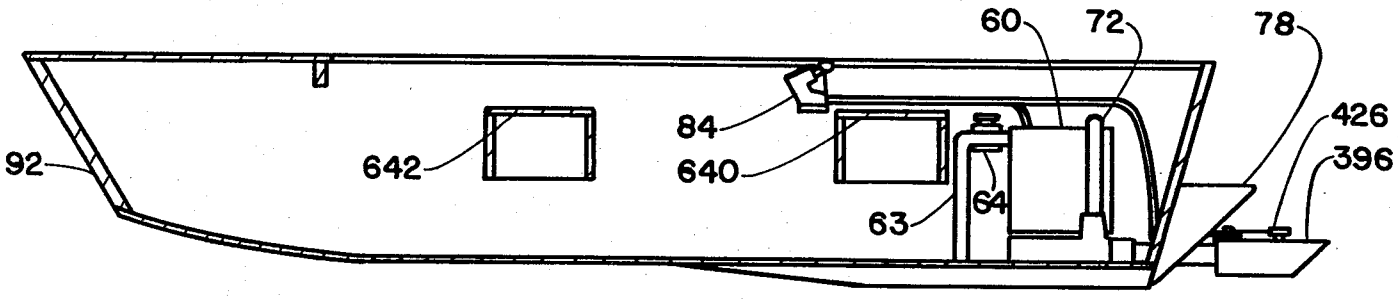
Figure 44:
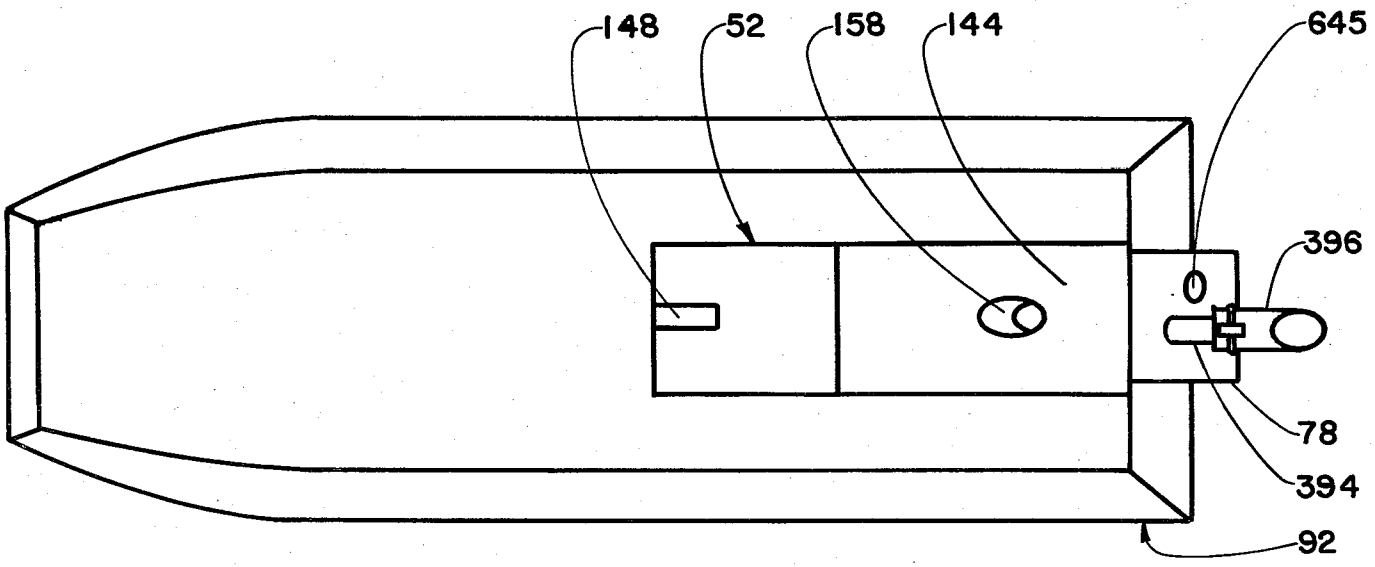
Figure 46:
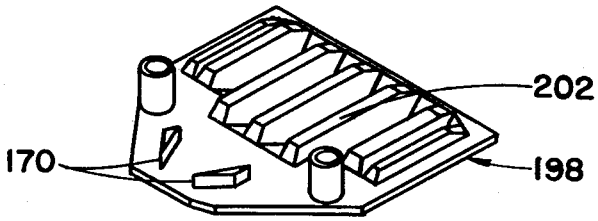
Figure 45:
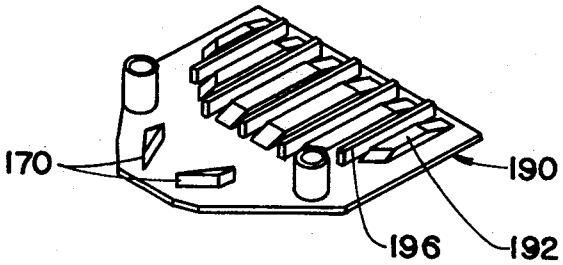
Figure 47:
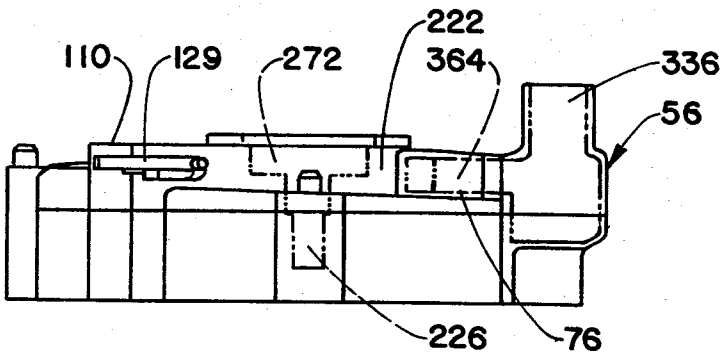
Figure 48:
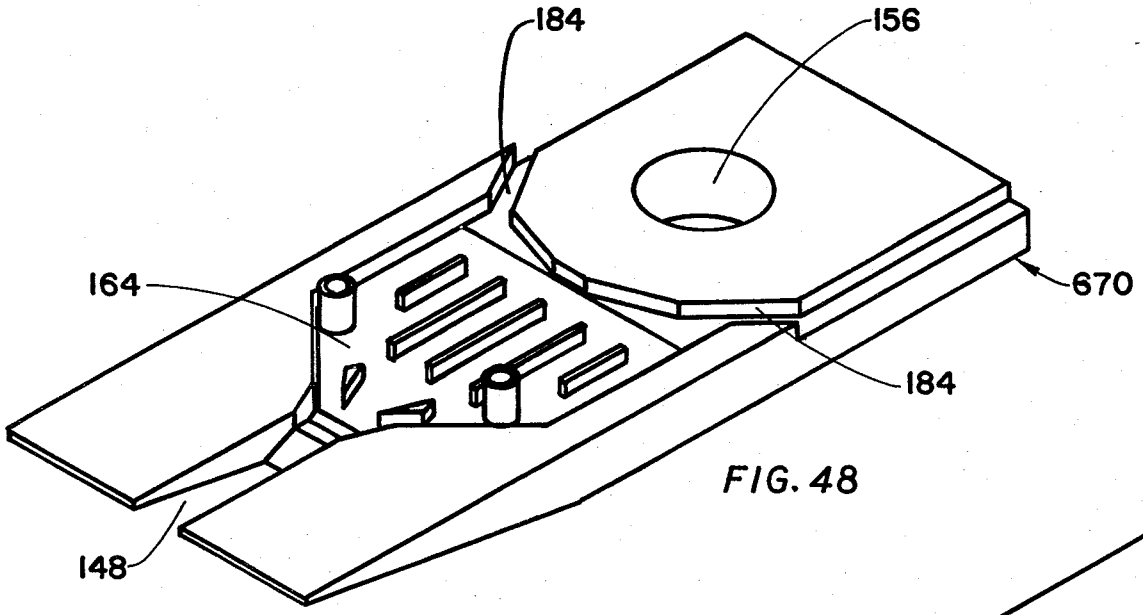
Figure 49:
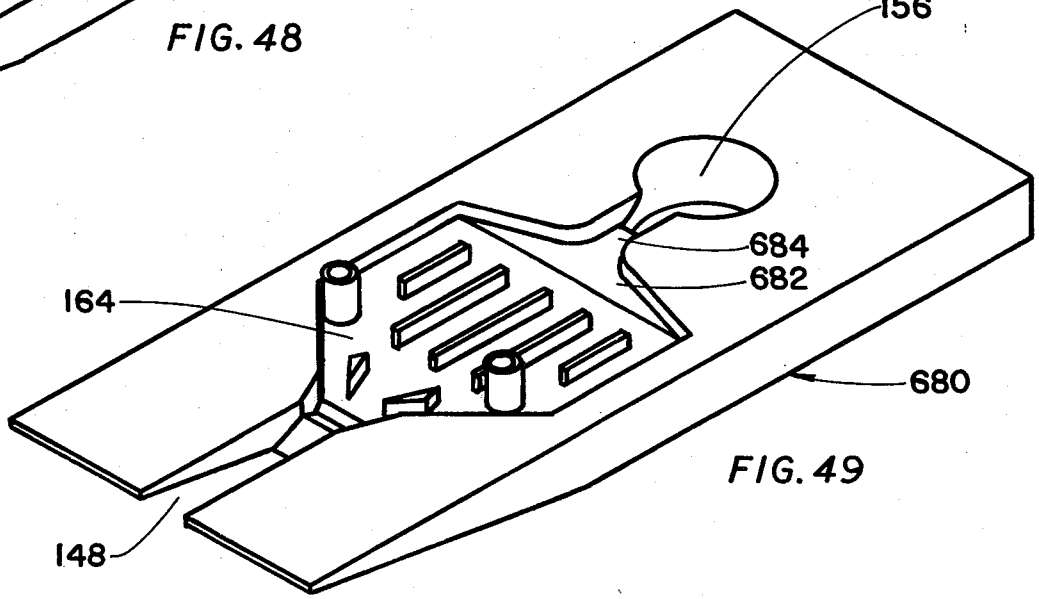
Figures 50, 51, 52:
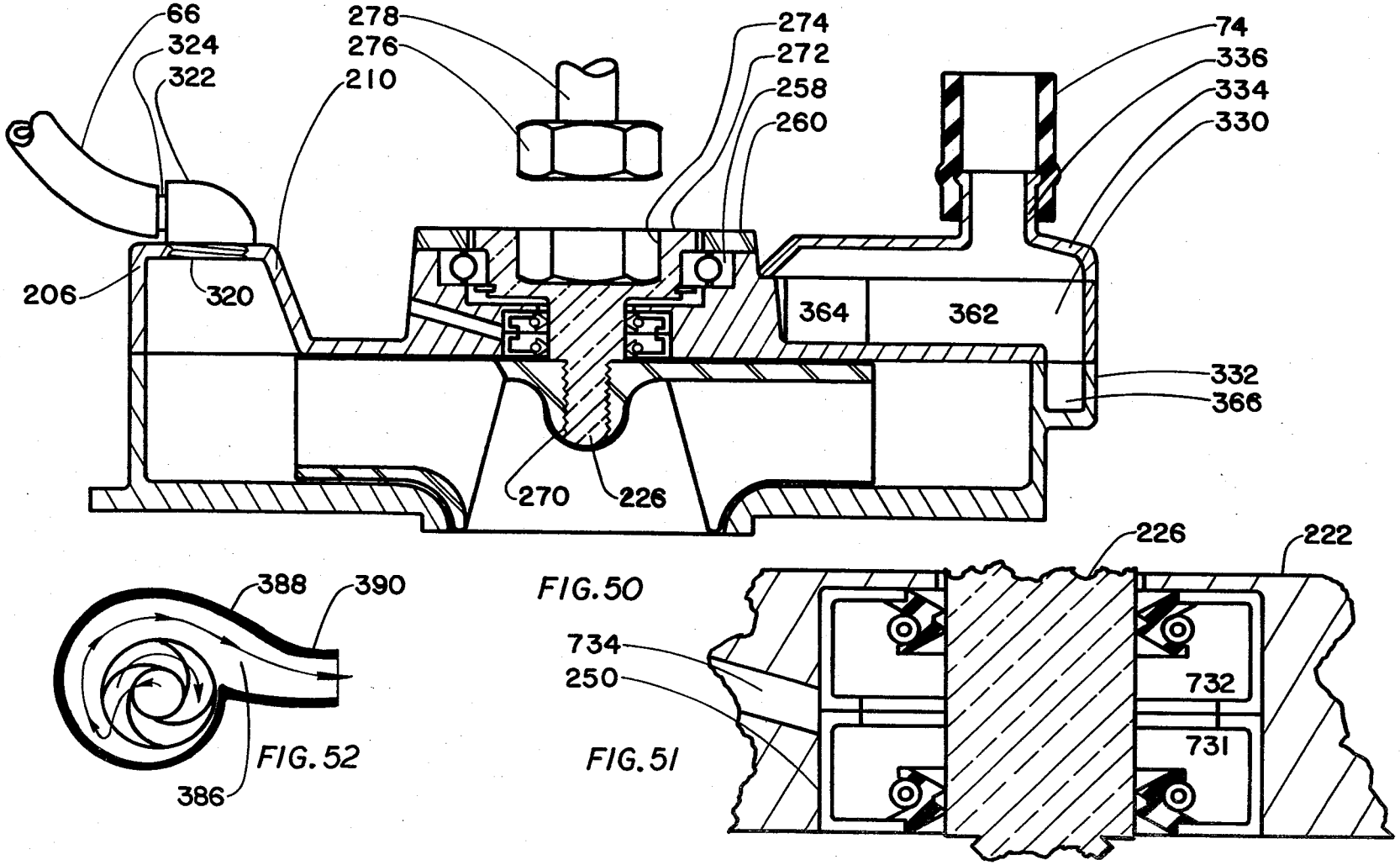
Figures 53, 54, 55, 56:
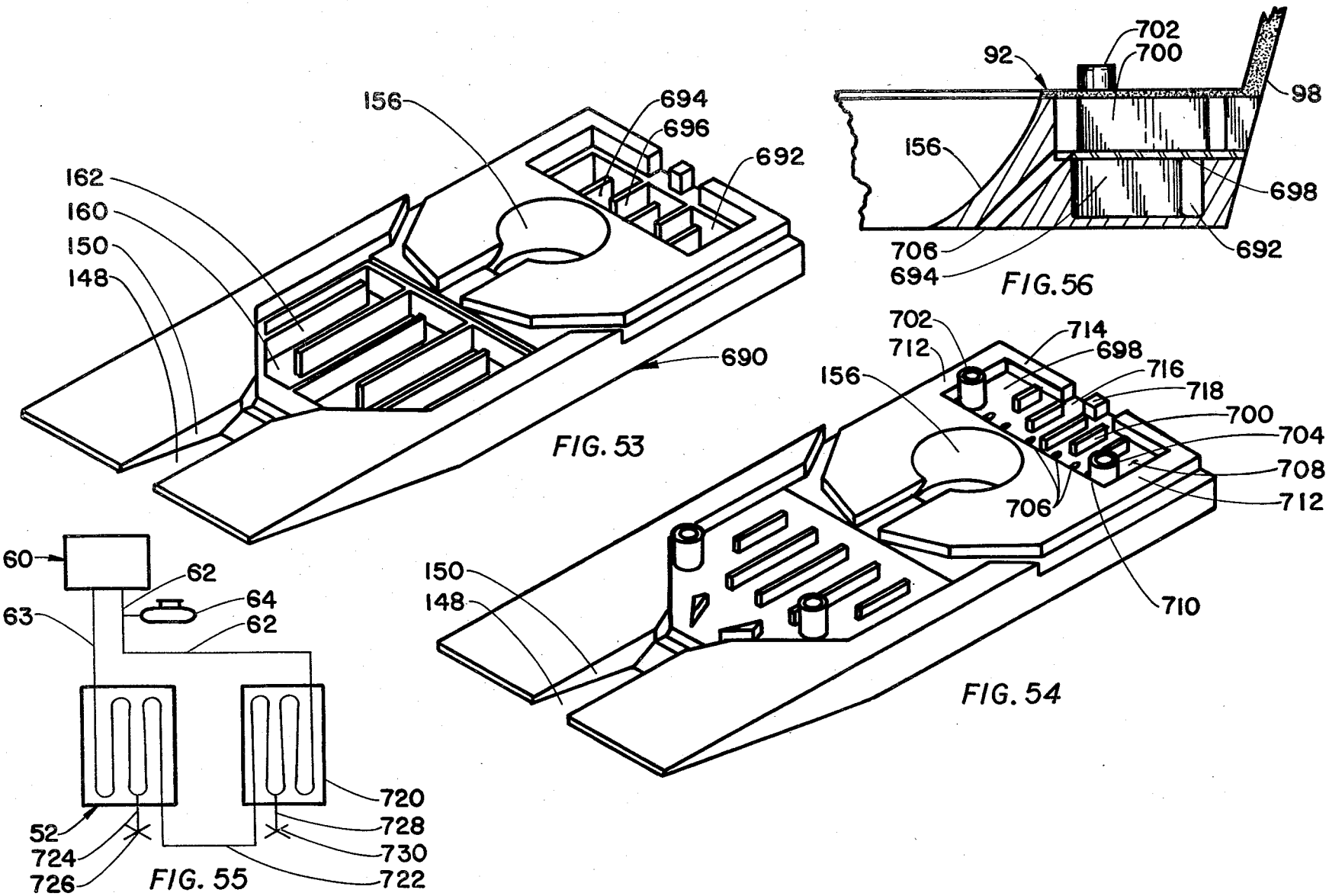
Figure 59:
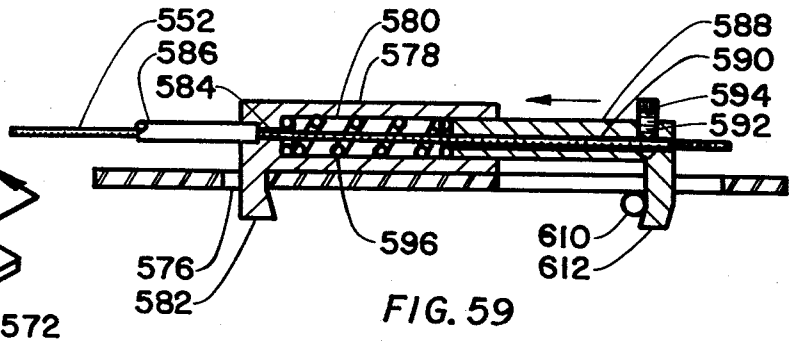
Figure 57:
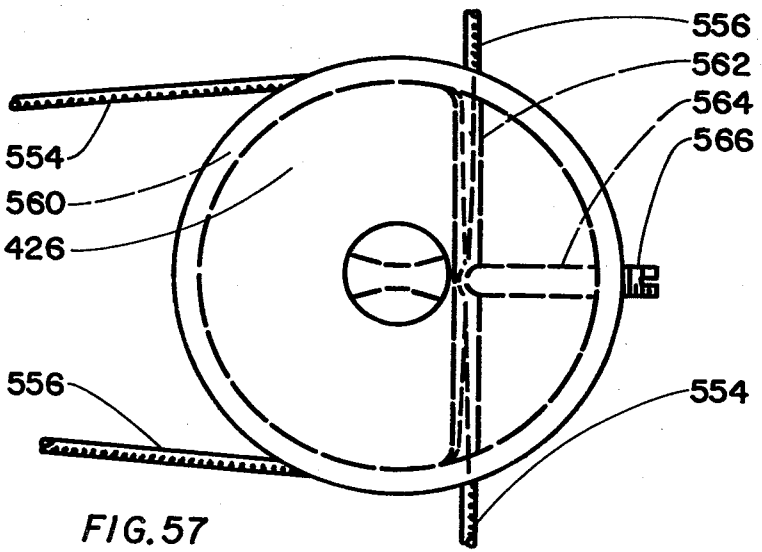
Figure 58:
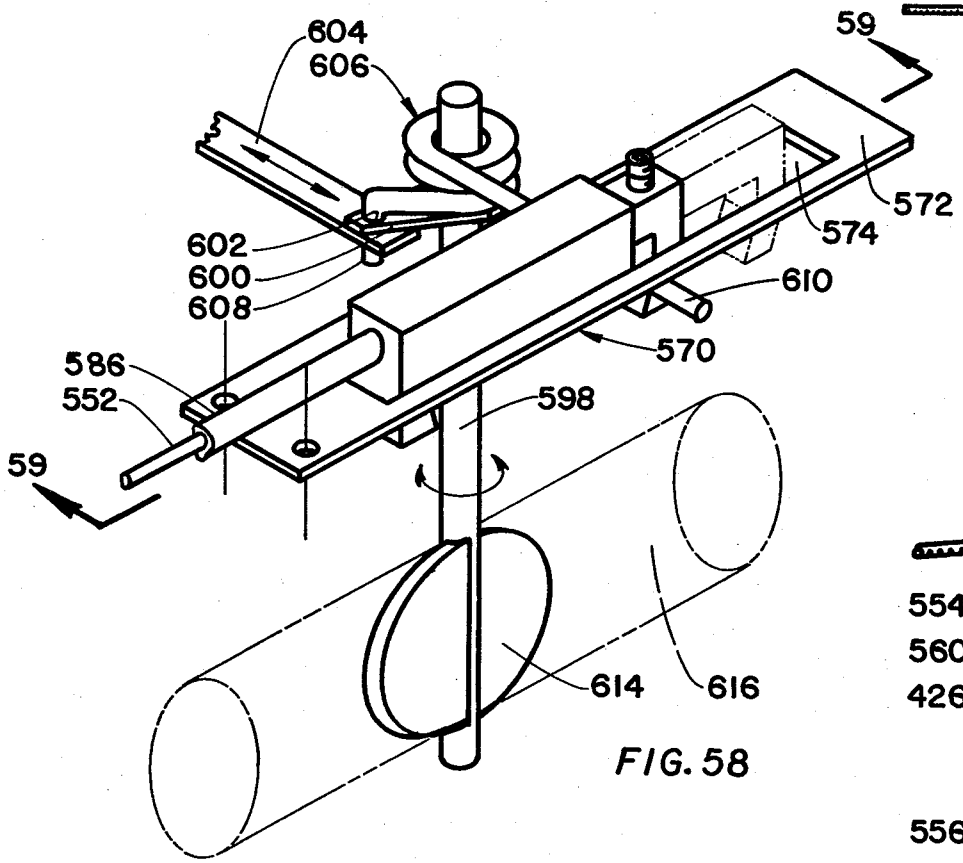
Figure 60:
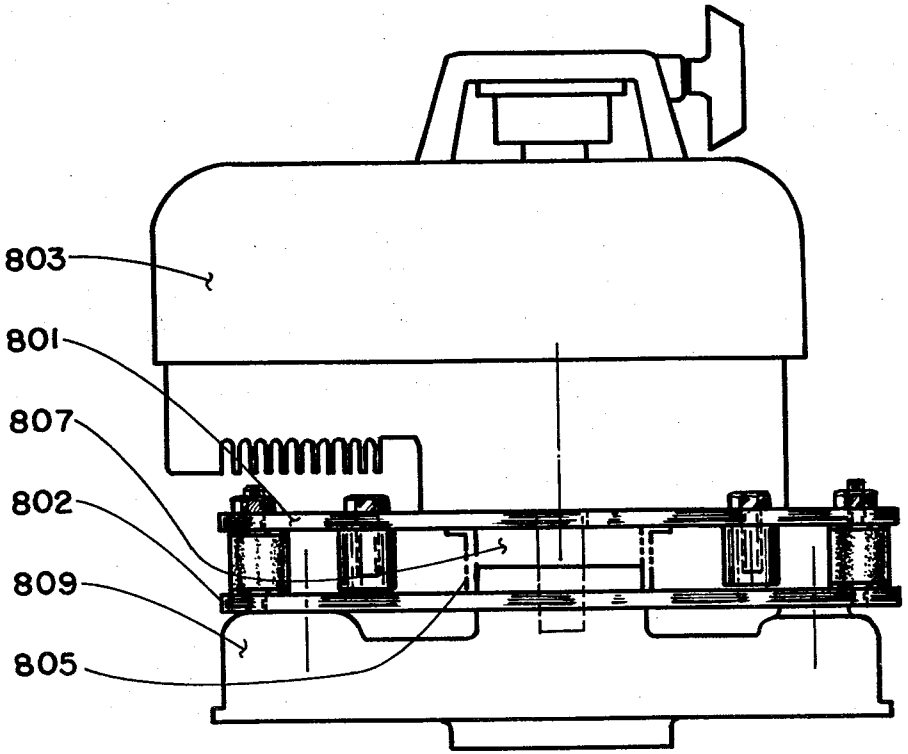
Figure 61:
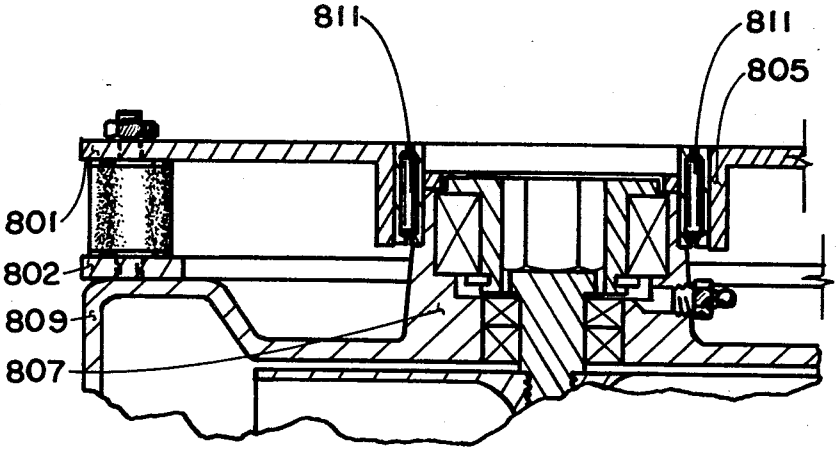
Figure 62:
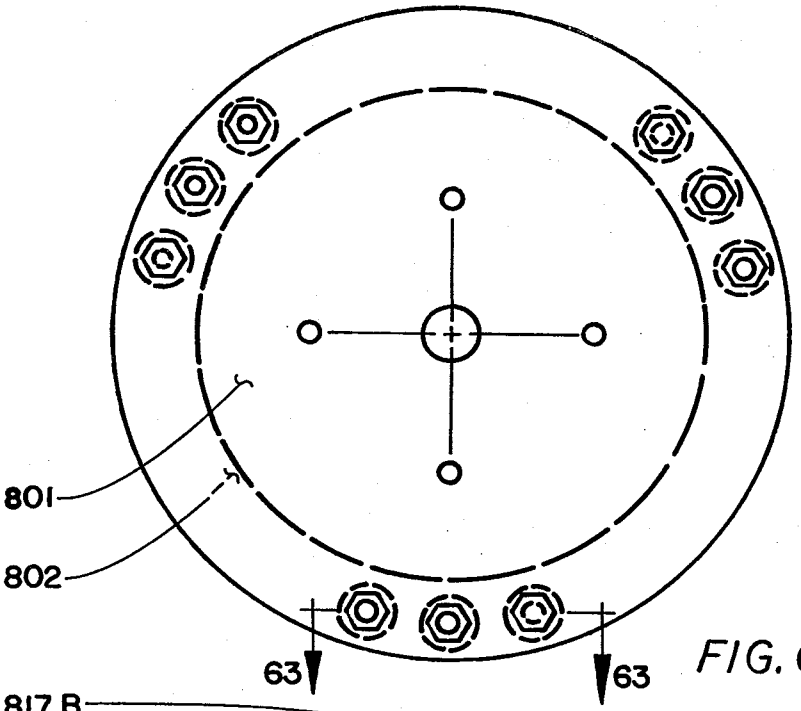
Figure 63:
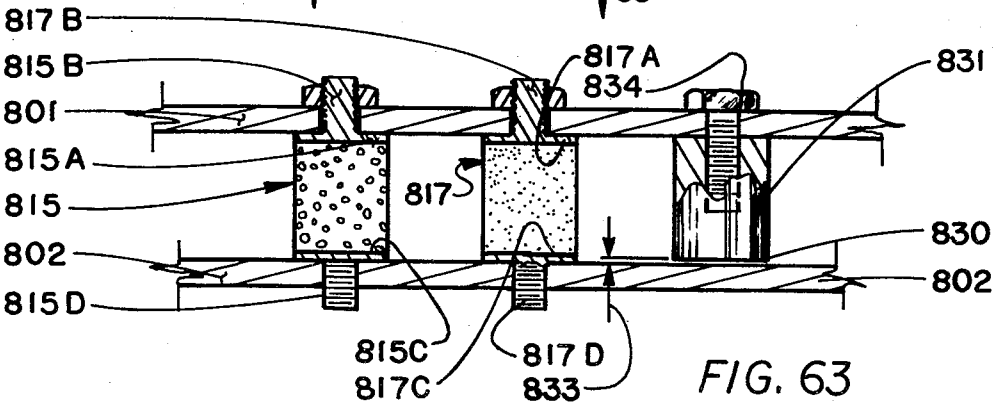

FIG. 3 taken on line 3—3 of FIG. 1, is a longitudinal, vertical cross-sectional view of said propulsion system and illustrates the motor in a block form;

FIG. 4 is an enlarged view of the impeller-seal coupling system and is illustrated in FIG. 3 and in FIG. 50;

FIG. 5, taken on line 5—5 of FIG. 3, is a fragmentary plan view looking at the deflector nozzle;

FIG. 6, taken on line 6—6 of FIG. 4, is a horizontal cross-sectional view looking at the sealing system for the impeller-sealing combination;

FIG. 7 is an isometric view of the heat exchanger of the propulsion system with passageway top plate exploded;

FIG. 8 is a lateral cross-sectional view of one species of the top plate of the heat exchanger and which top plate is used for heat dissipation;

FIG. 9, taken on line 9—9 of FIG. 7, is a lateral, vertical, cross-sectional view of a second species of the top plate;

FIG. 10 is a lateral, cross-sectional view of a third species of the top plate;

FIG. 11 is an enlarged view of the motor mount from FIG. 1;

FIG. 12 is a bottom plan view of the impeller and shows the inlet part of the impeller for both upper and lower working faces as well as the radial outlet part for the lower working face;

FIG. 13 is a top plan view of the impeller and shows the radial outlet part of the impeller for the upper working face;

FIG. 14 is part of the exhaust system and shows, in an exploded view, the smaller diameter tube and the larger diameter tube prior to placing the smaller tube in the larger tube;

FIG. 15 is a fragmentary, cross-sectional view illustrating the smaller tube inside the larger tube and with the larger tube swaged and welded at one end to contact the smaller tube and ready to receive sand;

FIG. 16 is a view of the exhaust tube preform constructed of the smaller tube in the larger tube and with the larger tube swaged and welded at both ends to the smaller tube;

FIG. 17 is a view of the exhaust system showing the exhaust tube preform after bending and trimming operation;

FIG. 18 is an isometric view of the bottom of the impeller and the inlet part of the impeller and the outlet part of the impeller lower working face;

FIG. 19, taken on line 19—19 of FIG. 18, is a lateral, cross-sectional view of the impeller;

FIG. 20 is an isometric view of the top part of the impeller and the radial outlet part of the impeller upper working face;

FIG. 21 is a longitudinal, cross-sectional view of the exhaust system illustrating the smaller tube inside the larger tube and illustrates the water inlet to the larger tube and also the exhaust wherein the water and exhaust gases mix in the smaller tube;

FIG. 22 is a lateral, cross-sectional view illustrating a fine coarse grain material, such as sand, between the inner tube and the outer tube prior to bending the two tubes to reach the configuration illustrated in FIG. 17;

FIG. 23 is a top, plan view of a portion of FIG. 1 and illustrates part of the pump itself, the exhaust resonance chamber, and part of the deflector system for the propulsion system;

FIG. 24, on an enlarged scale, illustrates part of the pump with the top plate removed so as to illustrate the exhaust inlet port and the path of travel of the exhaust out to the deflector on the propulsion system;

FIGS. 25–28 illustrate the control unit for controlling the throttle, for both forward and reverse thrust, and also for controlling the direction of the flow of water for steering the boat;

FIG. 25 is a vertical, cross-sectional view showing the throttle actuator open and the deflector nozzle actuator in full reverse position with a means for controlling throttle line tension shown in phantom lines;

FIG. 26 is a vertical cross-sectional view showing the throttle actuator fully open and the deflector nozzle actuator in full forward position;

FIG. 27 is a vertical, cross-sectional view showing the throttle actuator in an idle position and the deflector nozzle actuator in a forward position;

FIG. 28 is a vertical, cross-sectional view and is the same as FIG. 27 with the addition of cable for control purposes;

FIGS. 29 and 30 illustrate the control for forward motion and reverse motion; wherein FIG. 29 is a fragmentary view illustrating the control for the butterfly valve with the butterfly valve open for forward thrust;

FIG. 30 is a fragmentary, cross-sectional view illustrating the butterfly valve closed for reverse thrust;

FIG. 31 is a lateral, cross-sectional view of a transom seal illustrating where the exhaust tube and the thrust tube and the control cables go through the housing positioned in the transom;

FIG. 32, taken on line 32—32 of FIG. 31, is a vertical, cross-sectional view illustrating the rotatable bearing positioned in the transom and through which the exhaust pipe, thrust tube, and control cables are positioned and housed;

FIG. 33 is a fragmentary, cross-sectional view illustrating the butterfly valve in an open position in the deflector nozzle and the water flowing through the deflector nozzle;

FIG. 34 is a fragmentary; cross-sectional view illustrating the deflector nozzle and with the butterfly valve closed so that the propelling water is in a reverse position so that the boat reverses its direction or moves backwardly;

FIG. 35 is a vertical, fragmentary, cross-sectional view illustrating the deflector nozzle, the control for moving the deflector nozzle and with the butterfly valve in an open position;

FIG. 36, on an enlarged scale, taken on line 36—36 of FIG. 35, shows the break-away safety latch for allowing the deflector nozzle to move in case the deflector nozzle hits bottom;

FIG. 37, taken on line 37—37 of FIG. 35, is an elevational view looking into the deflector nozzle and with the butterfly valve in an open position so that the boat will move forwardly;

FIG. 38 is a vertical, cross-sectional view of another species of deflector nozzle and illustrates the pin relationship of the deflector nozzle for allowing a high-speed turn;

FIG. 39 is an end elevational view of a boat with the deflector nozzle on the outside of the transom and with the deflector nozzle pointed straight backward or on the longitudinal axis of the boat;

FIG. 40 is an end elevational view of the boat with the deflector nozzle pointed downwardly and toward the port side and illustrates the torque characteristic for turning the boat to the port side;

FIG. 41 is an end elevational view of the boat and illustrates the nozzle pointed toward the starboard side and illustrates the torque characteristic of the liquid from the deflector nozzle and for turning the boat in the starboard direction;

FIG. 42 is a top plan view of a boat with the invention installed therein and with an operator controlling the invention;

FIG. 43 is a longitudinal, vertical, cross-sectional view of a boat with the invention installed therein and showing the arrangement of the various components of the invention;

FIG. 44 is an underneath plan view of a boat showing the heat exchanger, the opening leading to the pump, and the discharge system;

FIG. 45 is an isometric view of the cover plate of FIG. 8;

FIG. 46 is an isometric view of the cover plate of FIG. 10;

FIG. 47 is a side elevational view of the pump section;

FIG. 48 is an isometric view of a second species of a heat exchanger;

FIG. 49 is an isometric view of a third species of a heat exchanger;

FIG. 50 is a vertical, cross-sectional view of the impeller, the impeller drive shaft, the connection for introducing cooling water to the exhaust manifold, the housing associated with the impeller, and the draft shaft;

FIG. 51 on an enlarged scale, is a vertical, cross-sectional view illustrating the upper casing hub for receiving the drive shaft and illustrates the seal associated with the drive shaft;

FIG. 52 is a lateral cross-sectional view of the impeller with the upper cover removed so as to illustrate the gross intake and discharge of fluid;

FIG. 53 is an isometric view of a heat exchanger having both a forward heat exchanging unit and an aft heat exchanging unit and with the cover plates removed from said units;

FIG. 54 is an isometric view of the heat exchanger of FIG. 53 and with the cover plates in position;

FIG. 55 is a schematic illustration of the front heat exchanger and the rear heat exchanger, the surge tank, and the connecting piping for the heat exchanger of FIG. 53;

FIG. 56 is a fragmentary, vertical, cross-sectional view of the rear heat exchanger of FIG. 54;

FIG. 57, on an enlarged scale, illustrates the cable connections to the pulley for steering the boat;

FIG. 58 is an isometric view of the throttle control for controlling the butterfly valve in the carburetor of the internal combustion engine or motor;

FIG. 59, taken on line 59—59 of FIG. 58, is a longitudinal, vertical, cross-sectional view of said throttle control;

FIG. 60 is a side view of the combination of the motor, the propulsion pump, and the motor mounts of the present invention;

FIG. 61 is a partial cross-section of a portion of FIG. 60, showing in more detail the relationship between one element of one of the motor mounts of FIG. 60, the motor, and the propulsion pump housing;

FIG. 62 is a plan view of several motor mounts of the present invention in position on motor mounting plates;

FIG. 63 is a cross-section of a portion of FIG. 62 taken along lines 63—63 in FIG. 62.

THE SPECIFIC DESCRIPTION OF THE INVENTION

With reference to the drawings, it is seen that in FIGS. 1–6 there is illustrated a general overall view of the invention wherein in FIG. 1 there is the modular marine propulsion unit 50. The unit 50 comprises a heat exchanger 52, an impeller 54, a pump 56, and a steering mechanism 58.

There is a motor 60 for powering the modular marine propulsion unit 50.

In FIGS. 1 and 3, it is seen that there is an output pipe 62 from the heat exchanger 52. The output pipe 62 connects with an expansion chamber 64. The expansion chamber can connect with the motor 60 for supplying cooling water to the motor 60. There is an input pipe 63 connecting with the motor 60 and with the heat exchanger 52 for taking hot water from the motor 60 and conveying it to the heat exchanger 52.

There is a pipe 66 connecting with the output of the pump 56. The pipe 66 connects with a filter 68 for filtering out large particles in the liquid from the pump 56. The filter 68, by means of a pipe 70, connects with an exhaust pipe 72. The exhaust pipe 72 connects with the exhaust from the motor 60 so as to convey the exhaust gases from the motor 60 to a flexible mount 74. The flexible mount connects with a plenum chamber 76. The plenum chamber 76 connects with a boot 78 by means of a pipe 80. A pipe 82 connects the pump 56 with the steering mechanism 58.

Figure 2:
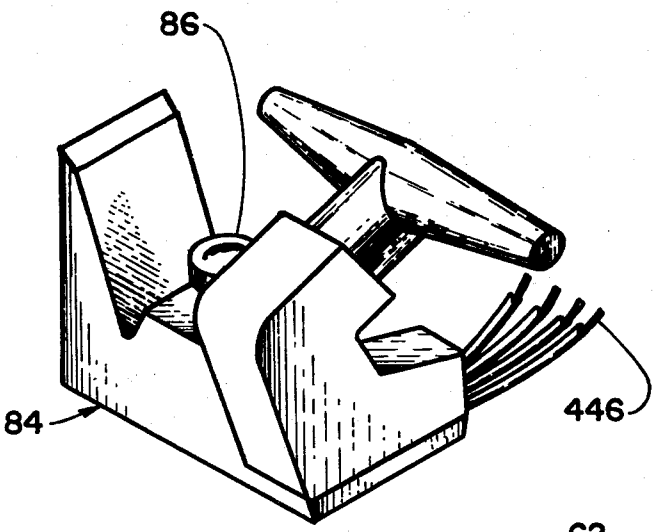
FIG. 2 is an isometric view of the control for the propulsion system and said control is mounted away from the propulsion system.

In FIG. 2, there is illustrated a control 84 for controlling the steering mechanism 58. The control 84 also controls the throttle and there is an electric start button 86 for starting the motor 60. The motor 60 is an internal combustion engine burning petroleum and the exhaust created by the motor 60 is exhausted through the exhaust pipe 72 through the plenum chamber 76, as previously stated.

In FIGS. 1, 3, and 7, there is illustrated the base 90 for the modular, marine propulsion unit. In FIG. 3, there is a fragmentary, longitudinal cross-sectional view illustrating the base 90 in the boat. In FIG. 42, there is a plan view illustrating the modular, marine propulsion unit in a boat and in FIG. 43, there is a longitudinal, vertical, cross-sectional view illustrating the modular, marine propulsion unit in the boat 92 and illustrating the base as positioned in an opening 94 in the bottom 96 of the boat 92. Also in FIG. 3, there is illustrated the base 90 and the propulsion unit 50 positioned adjacent to the transom 98 of the boat 92.

In FIG. 11, there is presented a partial fragmentary view of the pump 56 and the structure for mounting the motor 60 onto the pump 56.

There is a mounting bolt 100 having a threaded shank 102, a circular support 104, and a shank 106 having a groove 108.

On pump 56 is a mounting boss 110. The mounting boss 110 has a radial part 112, which radial part 112 is above the upper surface 114 of the pump 56. Also, the mounting boss 110 extends outside the circumferential wall 116 of the pump 56 so as to define an outstanding support 118.

In the upper part of the boss 110 and above the upper surface 114 of the pump 56, there is a radial groove 120. The radial groove 120 comprises a full groove 122, which full groove has a shoulder 124 at the outer part of the outstanding support 118. Also, in the inner part of the radial groove 120, there is a tapped recessed passageway 126 for receiving a bolt 128.

There is a spring rod 129 having a hole or passageway 130.

In operation, the mounting bolt 100 is screwed into the appropriate recessed tapped passageway in the motor 60.

In the mounting boss 110, there is a circular recess 134 and in the circular recess 134 there is positioned a bushing 136. It is to be realized that the circular recess 134 and the wear bushing 136 extend both above and below the radial groove 120.

After the mounting bolt 100 has been mounted in the motor 60, the mounting bolt 100 can be positioned and moved into the wear bushing 136. The spring rod 129 can be positioned in the full groove 122 and the bolt 128 screwed into the tapped passageway 126. Naturally, there is a washer 138 between the bolt 128 and the hole 130 in the spring rod 129. With the spring rod 129 in position in the full groove 122, the spring rod is in the groove 108 in the mounting bolt 100 so as to lock the mounting bolt in the circular recess 134 and the wear bushing 136 and thereby lock the motor 60 in position. If it becomes necessary to remove the motor 60 from the top of the pump 56, the spring rod 129 can be pulled away from the full groove 122 so as to bear against the shoulder 124. Then the spring rod 129 is positioned away from the groove 108 and the mounting bolt 100 can be pulled out of the circular recess 134 in the wear bushing 136 and the motor picked up and away from the pump 56.

In FIG. 1, it is seen that there are three mounting bolts 100. It is possible to have any reasonable number of mounting bolts 100, but from experience, I have found that three mounting bolts 100 are sufficient to position the motor 60 on the pump 56 and to lock the motor onto the pump 56.

Referring now to FIGS. 60–63, an alternative embodiment is disclosed for mounting the boat motor onto the propulsion pump. In this embodiment, a first or upper mounting plate 801 is secured to the lower end of the motor 803. The first mounting plate 801 is flat, relatively thin compared to its diameter, and is substantially circular in outline. It extends radially outward from a central hub bearing housing 805, of which it may form a part and which is configured to fit around the central hub 807 of impeller housing 809. A hub bearing 811 is positioned between bearing housing 805 and central hub 807.

A second or lower mounting plate 802 is, in the embodiment shown, secured to the top of impeller housing 809 by conventional means, such as pins or bolts. The second mounting plate is positioned beneath the first mounting plate 801, and the motor mounts of this embodiment are arranged therebetween, as described hereinafter.

Second mounting plate 802 in the embodiment shown is a metal ring or platform having an outside diameter which is approximately equal to the outside diameter of the first mounting plate 801, and an inside diameter which may vary but usually approaches the diameter of the largest object which may pass through it.

Alternatively, an upper surface of the impeller housing itself may be configured to serve as the second mounting surface, and a lower surface of the motor 803 may be configured to serve as the first mounting surface.

The motor mount shown in FIGS. 60–63 comprises three separate elements, each of which is secured to, and depends from, the first mounting plate 801, and two of which are secured to the second mounting plate 802 as well. There are three motor mounts, of three elements each, shown in FIGS. 60–63, located at spaced locations around the peripheries of the first and second mounting plates 801 and 802. It should be understood, however, that fewer or more motor mounts may be used in a particular application. In the propulsion pump and motor arrangement shown, however, three equally spaced motor mounts have been found to provide satisfactory results.

The three elements of each motor mount are spaced relatively close together on the periphery of the first mounting plate 801, compared to the distance between adjacent motor mounts, as seen in FIG. 62. Referring now to FIG. 63, the first and second elements 815 and 817 of the present motor mount comprise cylindrical blocks of impact-absorbing material having different durometer ratings. Although in the embodiment shown, the cylindrical blocks are made from rubber, other resilient materials, or even spring or hydraulic arrangements, could be used.

Provided on one end of each of the first and second elements 815 and 817, respectively, are end plates 815A and 817A (FIG. 63) which each have a threaded shaft 815B and 817B extending upward therefrom. Threaded shafts 815B and 817B extend through openings in the first mounting plate 801, and elements 815 and 817 are secured to the first mounting plate by threading nuts onto the respective threaded shafts to the point where the upper surfaces of end plates 815A, 817A bear against the underside of mounting plate 801.

Provided on the other end of each element 815 and 817 are end plates 815C and 817C, which each have threaded shafts 815D and 817D extending therefrom. Shafts 815D and 817D are screwed into corresponding threaded openings in second mounting plate 802, until ends plates 815C and 817C lie flat against the upper surface of second mounting plate 802.

The cylindrical blocks of elements 815 and 817 in the embodiment shown are approximately 0.75 inches long and 0.75 inches in diameter, while the end plates for each element are approximately 0.050 inches thick, thus resulting in an overall element length of 0.85 inches. It should be understood, however, that the above dimensions may vary, depending upon the particular application.

Element 815 in the embodiment shown is made from a hard rubber having a durometer rating of approximately 40 . Element 817 is substantially the same as element 815 in configuration and structure, except that it has a durometer rating of approximately 70. Although the durometer ratings are not critical, it is important that one of the elements have a substantially different durometer rating than the other.

One element must have a sufficiently high durometer rating to dampen the higher motor frequencies and to absorb the heavy motor vibrations. Such an element will have a natural resonant frequency in the range of the low frequency motor vibrations, however, and hence the low frequency motor vibrations will tend to be accentuated. The other element, however, has a substantially lower durometer rating, and has a natural resonant frequency in the higher range of motor vibrations. This element thus tends to reduce the lower motor vibrational frequencies, while the one element reduces the higher motor vibrational frequencies. The combination of the two elements thus compensate for each other's natural resonant frequency. Although durometer ratings of 40 and 70 have been specifically disclosed, they are not necessarily critical. It has been discovered that, for the embodiment shown, the lower durometer rating should be approximately one-half, ± 30%, of the higher durometer rating. This range may be slightly different for other arrangements, particularly concerning the distance between the two mounting surfaces.

It should be understood that even though two elements are shown in the drawings, a single element, incorporating two portions having the two different durometer ratings, could also be effectively used. Additionally, more than two elements have different natural resonant frequencies and durometer ratings may be used. Further, a combination element, incorporating materials of several different durometer ratings, may be also effectively used.

The third element in the motor mount is an impulse damping boss 831, which is comprised of a cylindrical block of hard, non-deformable material of approximately the same configuration and size as first and second elements 815 and 817. An opening is provided in one end of the third element 831. It extends into the element for approximately half its length, although the opening may pass through the third element, so that it also is capable of holding lubrication for the motor mount. The opening in element 831 is threaded, as is a corresponding opening in the first mounting plate 801.

The third element 831 is mounted in the embodiment shown by threading a bolt 834 through the opening in the first mounting plate and into the threaded opening in third element 831, until the upper end of the third element 831 is pulled flat against the undersurface of the first mounting plate 801.

The length of the third element 831 is slightly less than the lengths of elements 815 and 817, such that, when the motor is at rest, a slight gap 833, on the order of 0.010 inches, exists between the lower end of element 831 and the upper surface of the second mounting plate 802.

As indicated above, two openings are drilled in the second mounting plate 802 and are then threaded to receive the threaded shafts 815D and 817D, which depend from end plates 815C and 817C which are in turn secured to the bottom end of the cylindrical blocks of elements 815 and 817. In mounting, elements 815 and 817 are threaded down into the second mounting plate 802 until the lower surfaces of their respective end plates 815C and 817C bear against the upper surface of the second mounting plate 802. Element 831 is then threaded onto bolt 834 until its upper end bears against the undersurface of the first mounting plate 801. The second mounting plate, and elements 815 and 817, are then joined with the first mounting plate 801 and third element 831 such that threaded shafts 815B and 817B extend upwardly through the openings in the first mounting plate. Nuts are then threaded onto shafts 815B and 817B and tightened until end plates 815A and 817B bear against the undersurface of the first mounting plate 801.

The first and second mounting plates 801 and 802 and elements 815 and 817 are thus clamped into a unit, while element 831 is clamped to mounting plate 801 only. Other mounting means may be used in place of the bolts and nuts disclosed, including screws, pins and other means which can clamp the elements securely between the two mounting surfaces.

The first, second and third elements 815, 817 and 831 operate as a set to provide extremely good vibration damping. Element 831 damps out large, heavy vertical oscillations. It does not deform, and hence, the two mounting plates cannot come closer than the length of element 831. This results in a transfer of the deforming stress, in the form of a rotational component, to elements 815 and 817. Elements 815 and 817 then cooperate to softly damp out the remaining vibrations, by virtue of their different durometer ratings and resonant frequencies. This results in a substantial reduction in the amount of motor vibration transferred to the pump and attached systems, which is a very desirable result in boat applications, as well as other motor applications.

In FIGS. 1, 3, and 7, there is illustrated the marine propulsion unit 50 and in FIG. 3, there is illustrated the propulsion unit 50 in combination with the boat 92. There is illustrated the opening 94 in the bottom of the boat 92. The propulsion unit 50 is partially underneath the bottom 96 of the boat and is partially above the bottom 96 and in the boat 92.

The base 90 of the propulsion unit 50, see FIGS. 3 and 7, comprises a case member having a generally flat upper surface 140. The base 90 has a downwardly sloping leading surface 142 which bends into a flat bottom surface 144 which bends upwardly into a trailing upwardly inclined surface 146. In FIGS. 1, 3 and 7, it is seen that the base 90 is recessed in the upper part of the downwardly directed surface 142, at recess 148. The recess 148 has two opposed sides 150 and 152. Also, it is seen that there is an upwardly inclined surface 154 at the inner end of the recess 148 for directing water upwardly. The opposed sides 150 and 152 with the bottom 96 of the boat 92 define a channel for directing water to the upwardly inclined surface 154 which directs the water to the central part of the base 90. The water is directed to a heat exchanger, which will be discussed in a latter part of the specification.

In the central portion of the base 90, there is an input passageway 156. In the surface 144, there is an opening 158. It is seen that the opening curves upwardly and backwardly from the forward part of the surface 144 so as to direct a flow of water upwardly to an impeller 54 of the propulsion unit 50. Further, it is seen that the sides of the input passageway 156 are in the form of a smooth curve to lessen resistance by the passageway 156 to the flow of water to the impeller 54 and to also lessen the possibility of cavitation occurring and resistance to the flow of water in the passageway 156.

In FIG. 7, it is seen that there is a recess or cavity 160 in the upper part of the base 90. In this recess, it is seen that there are a number of baffles or ribs 162.

There is a cover plate 164 which fits over the recess 160 and has a number of downwardly directed baffles or ribs 162. The ribs or baffles 166 cofit in between the ribs or baffles 162 so as to direct the flow of the fluids, such as water, in the recess 160. In effect, the recess 160, ribs or baffles 162, and cover plate 164 having downwardly directed ribs or baffles 166 constitute a heat exchanging element 52. The ribs or baffles 162 and the ribs or baffles 166 are cooling fins, and conduct heat to the base 90 and to the downwardly sloping leading surface 142 and also to the flat bottom surface 144 so that the heat can be absorbed and dissipated in the water flowing by the base 90. Also, water flows over the upper surface of the cover plate 164 so that additional heat is dissipated as the cooling fins 166 conduct heat from inside the recess 160 to the cover plate 164. On the top of the cover plate 164 are additional cooling fins 168. Water flowing past the cooling fins 168 absorbs and dissipates the heat from the cover plate 164.

In FIG. 7, it is seen that the cover plate 164 fits over the recess 160 in the base 90. In FIG. 1, there is illustrated the cover plate 164 in position over the recess in the base 90.

On the leading part of the upper surface of the cover plate 164 are two spaced apart diffusers 170 for directing water to and around the cooling fins 168. Also, in FIG. 7, it is seen that there are two nipples 172 and 174 for allowing the passage of a fluid, such as water, into the recess 160 and also out of the recess 160.

The recess 160 with the baffles 162 and the plate 164 with the fins 166 and 168 functions as a heat exchanger for the internal combustion engine or motor 60. The water flowing around the base 90 of the propulsion unit 50 and also over the top of the cover plate 164 cools the water flowing in the recess 160 and around the baffles 162 and the fins 166.

In FIGS. 1 and 7, it is seen that rearwardly of the recess 160, there is a flat or smooth support surface 180.

In FIGS. 1 and 7, it is seen that there is an inlet passageway 182 to allow water leaving the top surface of the cover plate 164 to flow rearwardly and also into the input passageway 156 to the impeller. Also, on each side of the upper part of the base 90, there is an output passageway 184. The output passageway 184 is slanted rearwardly. Further, the upper part of the base 90 near the flat or smooth support surface 180 is recessed at 186 to allow water to flow past the base 90 and underneath the hull of the boat. The water flowing around the base 90, viz., underneath the base 90, around the sides and also over the top surface of the cover plate 164, functions as a coolant for the cooling fluid or water of the motor 60.

In FIGS. 8 and 45, there is illustrated another cover plate 190 having ridges 192, a lower base portion 194 and upwardly directed fins 196. The cover plate 190 functions similarly to the cover plate 164. It functions to transfer heat from the coolant flowing in the recess 160 to the water flowing over the outer surface of the cover plate 190.

In FIGS. 10 and 46, there is illustrated a third modification of a cover plate 198 hving deep corrugations 200. Also, the upper surface 202 of the cover plate 198 is substantially in the same plane. In the cover plate 198, there are downwardly directed fins 204. The cover plate 198 functions substantially the same as the cover plate 164 in that the coolant flowing in the recess 160 transfers heat energy to the cover plate 198 which, in turn, transfers the heat energy to the water flowing over the outer surface of the cover plate 198.

In FIGS. 1, 3, 4, 23, 24, 50 and 51, there is a view of the housing 206 for the impeller 54.

The housing 206 comprises a lower base 208 and an upper cover 210. The upper cover 210 comprises an upper, outer, circular surface 212 which, on the outer part of the housing, is directed downwardly at 214 to meet with the upwardly directed wall 216 of the base 208. The inner part of the upper, outer, circular area 212 slopes downwardly and inwardly at 218 and then bends into a flat inner circular section 220. The circular section 220 then forms a hub 222. The hub 222 provides support for the bearing for the drive line 278 from the motor 60 and also provides support for the drive shaft 226 which connects with the impeller 54.

In FIGS. 12, 13, 18, 19 and 20, there is illustrated the impeller 54.

In FIGS. 12 and 13 there are illustrated views of the top and bottom of the impeller 54.

In FIGS. 12 and 13, it is seen that there are two spaced apart annular housings 221 and 223. Also, it is seen that there is a semicircular shoulder 225 spaced from the upper surface 227, see also FIG. 20.

The spaced apart annular housings 221 and 223 slope away from their central part to the external periphery 228 and define a sloping surface 230. Also, the annular housings 221 and 223 each have a through passageway 224 so that liquids, such as water, can flow through the passageway 224 to the other annular housing. Each annular housing 221 and 223 defines an approaching semicircular shoulder 232 and a receding circular shoulder 234. It is seen that the approaching circular shoulder 232 on the housing 221 and the receding circular shoulder 234 on the housing 223 define a passageway 236. Also, the approaching circular shoulder 232 on the housing 223 and the receding shoulder 234 on the housing 221 define a passageway 238. There is a hub 240 between the through passageways 224 in the housings 221 and 22, which hub 240 is internally tapped at 242.

In effect, the lower part of the impeller 54 has a central passageway 236 and 238 which is in a generally S-configuration and on each side of this passageway are two walls defining the path of flow of the liquid through the impeller 54. The central part of the impeller at the housings 221 and 223 is the thickest part of the impeller and the sloping surfaces 230 slope away from the thicker central portion of the impeller in a smooth curving surface.

It is to be noticed in FIGS. 18 and 19, that the hub 240 is smooth and rises from a relatively wide base to a relatively narrow outer portion so as to allow the liquid to flow past the hub without cavitation effects.

The sloping surfaces 230 have a relatively rough surface, on the order of a 500 root mean square finish, or 5/10,000" finish. The surface for the passageways 236 and 238 and the surfaces 244 and 246 on the other side of the impeller should be as smooth as possible so as to induce laminar flow and to decrease turbulent flow. Surface 243, on the impeller's other side, also has a 500 root mean square surface, resulting in turbulent flow over this relatively rough surface when the impeller is rotated against a stationary housing.

In FIG. 20, there is illustrated the flat surface 243 is a generally S configuration. It is seen that there are the passageways 224 from the housings 221 and 223 on the underneath side of the impeller, which allows fluid to flow to the upper part of the impeller. Also, there is a curved surface 244 over which the fluid from the passageways 224 flows. The curved surface 244 should be as smooth as possible in order to induce laminar flow and to eliminate turbulent flow. At the junction of the flat surface 243 and the curved surface 244, there is a shoulder 246. The shoulder 246 acts as a barrier to the flow of liquid from the passageways 244 to the curved surface 244. The shoulders 246 direct the flow of liquid from the passageways 224.

In effect, the liquid or water flows into the passageways 236 and 238 from the central part of the lower surface of the impeller 54 and away from the hub 240. Then, the liquid flows through the passageways 224 and over the curved surfaces 244 and out of the impeller 54, as a result of the impeller's rotation by the motor 60.

In FIGS. 3, 4 and 50, it is seen that the impeller is connected to a drive shaft or coupler 226 with the drive shaft being screwed into the internally tapped passageway 242. The housing 206 for the impeller 54 has a recessed cavity 256 for receiving a bearing 258. The bearing 258 is around the upper part of the shaft or coupler 226. Also, the housing 206 has the hub portion 222 which has a recess 250. In the recess 250 are positioned seals 252 to lessen the possibility of water flowing up into the boat and into the bearing region. In the upper part of the hub 222, it is seen that there is a circlar recess 256 for housing the bearing 258 for the shaft 226. There is a cap 160 for holding the bearing 258 in the circular recess 256. Also, it is seen that there is a grease fitting 262 in the passageway 264. By forcing grease into the grease fitting 262 in the passageway 264, the bearing 258 can be lubricated.

The drive shaft or coupler, 226 is externally threaded at 270. In the drawings, it is seen that the upper part of the drive shaft 226 expands outwardly to form a housing 272 having a recess 274 in the configuration to receive a hex nut 276.

The motor 60 has a downwardly directed drive line 278. On the lower end of the drive line 278 is screwed or positioned the hex nut 276. In the drawings, it is seen that the hex nut 276 is positioned above the recess 274 and in driving position, the hex nut 276 is in the recess 274. The clearance between the outer dimensions of the hex nut 276 and the inner dimensions of the recess 274 may be in the range of 0.005" to 0.010".

In practice, the motor 60 can be readily mounted on the housing for the impeller 54 with the hex nut 276 and drive line 278 in the recess 274. As is recalled, there are three mounting bolts 100 in the lower part of the motor 60. To remove the motor 60 from a driving relationship with the impeller 54 means that the cooling lines 62 and 63 are disconnected from the motor, the exhaust pipe 72 is disconnected from the rubber pipe or housing 74 and the motor is disconnected from the high pressure water line 70. Then, the mounting bolts 100 can be released from the housing for the impeller, see FIG. 11, and the motor lifted away from the impeller 54. It is not necessary to use a wrench or other mechanical equipment to remove the hex nut 276, the drive line 278, and the motor 60 from engagement with the housing 272 and the recess 274 in said housing 272.

In FIG. 6, a lateral cross-sectional area taken on line 6—6 of FIG. 4, there is illustrated the shaft or coupler 226, the seal 252, and the hub of the housing 206. FIG. 6 shows the circular configuration of these components in a lateral cross-sectional view.

The motor 60 is an internal combustion engine, such as a two-cycle engine, although it can be a four-cycle engine. This motor must have an exhaust. The exhaust pipe 72 connects with the motor and carries the exhaust products of combustion away from the motor. The exhaust pipe 72 comprises an inner pipe 286 and an outer pipe 288. The inner pipe 286 is of a smaller external diameter than the internal diameter of the pipe 288 and is longer than the pipe 288, see FIG. 14. In FIG. 15, it is seen that the outer pipe 288 is positioned around the inner pipe 286 and the right end of the pipe 288 is swaged and rigidly joined at 290 around the end of the pipe 286.

Then, a coarse grain sand of approximately ½ mean wall distance between pipe 286 and pipe 288 in size (approximately equal to 0.025 inches in this application) is poured into that annual area between the pipe 286 and the pipe 288 and that part of the pipe 288 is swaged and rigidly joined (by a process such as welding or brazing) at 292 to the pipe 286 to form an intermediate unit 294. Then, the intermediate unit 294 is bent as indicated in FIG. 17 to form a configuration of a modified-G. In FIG. 22, there is illustrated a cross-sectional view showing the inner pipe 286, the outer pipe 288, and the sand 296. Then, the swaged end 290 is cut away or removed to form an opening 298, as illustrated in FIG. 17. After the swaged portion 290 has been cut away from around the inner pipe 286, the sand can be dumped out or removed in that annular area between the pipes 286 and 288. Then, the pipe 288 in the area of 298 can be swaged and rigidly joined around the inner pipe 286 to form the swaged area 300 and to leave a nipple 302.

A housing 304 can be built onto the pipe 288 and this housing can have a passageway 306 connecting with a passageway or opening 308 in the pipe 288. The passageway 306 can be tapped at 309. The space between the pipe 288 and the pipe 286 can be referred to as an annular space 310. The passageway 306 and the passageway 308 lead into this annular space 310.

In FIG. 21 it is seen here that in swaged portion 292 there is a tapped passageway 312 in the pipe 288. Also, there are two aligned passageways and/or holes 314 in the inner pipe 286. A bolt 316 can be screwed into the tapped passageway 312 so as to pass through the two passageways 314 or to pass through only one of the passageways 314. The reader recognizes that the bolt 316 with the passageways 314 functions as a valve to control the flow of water from the pump to the cooling jacket or through the annular space 310 which is a cooling jacket. The water enters in through the passageways 306 and 308 into the annular space 310 and flows around the exhaust pipe 286 and out through the passageways 314 so as to cool the exhaust gases in the exhaust pipe. The bottom part of the annular space 310 can be cleaned by removing the bolt 316 from the tapped passageway 312.

The cooling water for introduction into the annular space 310 and for cooling the exhaust pipe 72 comes from the impeller 54 in the housing 206. In the drawings (especially FIG. 50), it is seen that there is a tapped passageway 320 in the housing 206. There is an angle adapter 322 which connects with an outlet pipe 324. Then, the pipe 66 connects with the pipe 324 and also with the filter 68. Another pipe 70 with the filter 68 connects with the tapped passageway 309 in the housing 304. It is seen that there is a positive speed of cooling water from the impeller 54 in the housing 206 to the annular space 310 and out through passageways 314 for cooling the exhaust gases flowing through the inner pipe 286.

The exhaust from the motor 60 and fluid from space 310 are introduced into a resonance chamber 330. In regard to the resonance chamber, the reader is asked to look at FIGS. 1, 3, 23, 24 and 50.

In FIG. 50, it is seen that the rear part of the housing for the impeller has a circumscribing wall 332 which comes out of the rear part of the lower part of the housing for the impeller and rises upwardly. Then, there is a cover 334 for the resonance chamber 330. The cover 334 contacts the upper part of the circumscribing wall 332 and also contacts the upper cover 210 near the hub.

The cover 334 rises upwardly into a nipple 336. A rubber pipe 74 fits over the nipple 336.

In FIGS. 24 and 50, there is illustrated a baffle 360 having one wall member 362 connecting with the circumscribing wall 332. Also, the wall member 362 goes to another angle 364 at an angle to 362. In FIG. 50, it is seen that the circumscribing wall 332 and the wall member or baffle 362 define a passageway 366 in the lower part of the resonance chamber 330.

In the rear part of the circumscribing wall 332, there is a nipple 368 which defines an outlet passageway 370.

In the outlet passageway 370, there is positioned an exhaust pipe 372. In FIGS. 32, 31, 23, 3 and 1, it is seen that the exhaust pipe 372 goes through an opening 374 in the transom. There is a positioning flange 376 which is positioned on the outward part of the transom 98. The positioning flange 376 has a through passageway 378.

There is a boot 78 positioned in the passageway 378. There is positioned in the boot 78 a nozzle head 380. In the nozzle head 380, there is an opening or passageway for receiving and positioning the exhaust pipe 372.

The positioning flange 376 may be attached to the transom 98 by means of a bolt or screw and in between the flange 376 and the transom 98, there may be positioned a sealer. A commercially available sealer which is not harmed by water may be used.

In FIGS. 31 and 32, there is illustrated a modification showing the transom 98, the positioning flanges 376, the nozzle head 380, a sealing material 382 between the positioning flanges 376 and the nozzle head 380, an opening or passageway 384 for receiving the exhaust pipe 372, and several small openings 736 for receiving and sealing the ends of the cable sheaths for controlling lines 554 and 556 for steering and line 446 for butterfly valve 430.

In FIG. 52, there is illustrated a lateral cross-sectional view of the impeller with the upper cover 210 removed illustrating an exhaust port 386. The housing for the impeller defines an outlet housing 388 for the exhaust port 386. There is positioned in the port 386 in the outlet housing 388, a nozzle tube 390. The nozzle tube carries the water forced out by the impeller. In other words, the water passing through the nozzle tube 390 propells the boat 92. The reactionary force of the water being shoved out of the nozzle tube 390 propells the boat 90 forwardly.

In FIG. 31, it is seen that in the nozzle head 380 there is a passageway 392 for receiving the nozzle tube 390.

The impeller 54, upon being driven by the motor 60, allows water to flow into the propulsion system and then the water is discharged through a discharge tube 394. It may be of assistance to look at FIGS. 1, 3, 5, 23, 24, 29, 30, 33, 34, 35, 36 and 37.

In FIG. 31, it is seen that there is an opening 392 in the nozzle head 380. As is recalled, the nozzle head 380 is positioned in the positioning flange 376. The discharge tube 394 is positioned in the opening 392 in said nozzle head.

In the drawings (especially FIGS. 33, 34, 35), it is seen that on the outlet end of the discharge tube 394 there is a housing 396. The housing has a small, circular inner part 398 (formed on the end of discharge tube 394), a shoulder 400, and a large outer circular part 402. The shoulder 400 connects the inner cylindrical member 398 and the outer cylindrical member 402. Actually, in FIGS. 33, 34 and 35, it is seen that the upper portion or part 398 of the housing 396 is pressed inwardly while the part 402 of the housing 396 is not altered. In FIG. 37, it is seen that the inner part 398 of the housing 396 is cupped inwardly at 404 to form a housing recess. Also, in the shoulder 400, see FIGS. 35 and 36, there is an opening or passageway 406. In the inner part 398 of the housing, there is an opening or passageway 408. Aligned with the passageway or opening 408 is an opening or passageway 410 in the discharge tube 39.

A bracket 412 having a first leg 414 and a second 416, attaches together the outer part of the discharge tube 394 and the housing 396. The leg 416 projects through the opening 408 in the inner part 398 of housing 396 and also through the opening 410 in the discharge tube 394. The leg 414 projects through the opening 406 in the shoulder 400. A spring 418 assists in positioning the bracket 412 and thereby the housing 396 onto the discharge tube 394. One end of the spring 418 passes through a passageway 422 in the bracket 412 and is positioned in said bracket 412 while the other end 420 passes around the housing 396 and is positioned by means of a shim 424. The shim 424 is welded onto the upper part of the pressed in housing 396. The configuration of the end 420 of the spring 418 next to the shim 424 (see FIG. 1), prevents movement of the spring 418.

In FIG. 35, it is seen that the spring 418 has positioned the bracket so that the second leg 416 is in the opening 408 and also in the opening 410. For release purposes of the housing 396, the bracket 412 can be moved so that the second leg 416 is not in the opening 408 and is not in the opening 410. This allows the housing 396 to be moved upwardly from the discharge tube 394. This is a safety feature for the housing 396, for if the forces on the housing 396 tend to rotate the lower part of the housing 396 away from the discharge tube 394, the housing 396 may break away from the tube 394 without damage to the housing 396. Further, the leg 416 functions as a pivot point or pivot center for the housing 396 to rotate around, in a horizontal direction, generally, around the discharge tube 394.

In FIG. 35, it is seen that there is a shim 424 welded onto the inner part of the housing 396. There is positioned on the shim 424 a pulley 426 having a downwardly directed pulley shaft 428. The pulley shaft 428 passes through an opening or passageway in the shim 424 and also through an opening or passageway in the inner part 398 of the housing 396 and also through an opening in the outer part of the discharge tube 394. From this, it is seen that the housing 396 is free to rotate around the pulley shaft 428 and thereby use the pulley shaft 428 as a pivot point. In FIG. 35, it is seen that the pulley shaft 428 and the second leg 416 are substantially aligned with each other so that these two together function as a pivot point around which the housing 396 can rotate with respect to the discharge tube 394 (for variation of this concept, please see FIGS. 38, 39, 40 and 41).

In FIGS. 33, 34, and 35, it is seen that there is a butterfly valve 430 in the housing 396. The butterfly valve 430 has a tendency to pop in an open position as illustrated in FIG. 33, due to the flow of water in the housing 396 and past the valve 430; or, to pop into a closed position as illustrated in FIG. 34.

In FIG. 33, the flow of water 432 past the butterfly valve 430 and past the housing 396 propels the boat in a forward direction.

In FIG. 34, with the butterfly valve closed, the flow of water 432 out of the housing 396 and by the outside of the discharge tube 394 puts the boat into reverse so that the boat will back up. Due to the configuration of housing 396 relative to discharge tube 394, as shown in FIGS. 33–35 and 37, most of the water discharged between housing 396 and discharge tube 390 when butterfly valve 430 is closed is along the sides of discharge tube 394. In such an arrangement, the discharge is directed in a forward direction along the sides of the boat, and specifically avoids the area of intake 158 in the propulsion inlet 50.

When the forward discharge from housing 396 is directed to the vicinity of intake 158, as is done in the prior art known to the inventor, a vortex is created in the vicinity of the intake, resulting in a loss of water volume into the propulsion unit, which in turn results in a significant reduction in thrust. Prior art jet boats having such a discharge thus have relatively small thrust capabilities in reverse.

Although the structure shown in FIGS. 33–35 and 37 is sufficient to produce the kind of forward discharge which substantially avoids the creation of a vortex in the vicinity of the propulsion intake, lengths of tubing or similar flow routing means may be added to the structure shown to channel the water discharged between housing 396 and discharge tube 394 further forward of the boat, to the precise location desired, in order to avoid any chance of vortexing and to increase the efficiency of the boat in reverse in particular applications. Such a flow routing means is shown partially at 397 in FIG. 43.

To repeat, the butterfly valve 430 tends to either jump into or pop into the open position illustrated in FIG. 33 or to jump into or pop into the closed position illustrated in FIG. 34. To control the movement of the butterfly valve 430, there is a control. In FIG. 37, it is seen that there is a shaft 434 on which the butterfly valve 430 is positioned. The shaft 434 passes through the walls of the housing 396. On top of the housing 396 (see FIGS. 5, 29 and 30), there is positioned a pulley 436. The pulley 436 is approximately, three-quarters of a pulley having a first shoulder 438 and a second shoulder 440. There is a radial tapped passageway 442 in the pulley 436. A bolt 444 is screwed into the radial passageway 442 and abuts against a cable 446. The cable 446 is squeezed or positioned between the bolt 444 and the shaft 434. On the outer surface of the housing 396, there is positioned a stop 448. There is a spring 450 having one end 452 wrapped around the stop 448 and which spring bends back on itself at 454 and then makes a loop 456. The spring 456 then forms a buttonhook 458 for receiving the bolt 444 or through which buttonhook the bolt 444 can be positioned. The spring 450, in conjunction with the pulley 436, tends to maintain the butterfly valve 430 in the open position as illustrated in FIG. 29 or in the closed position as illustrated in FIG. 30.

In FIG. 29, the first shoulder 438 abuts against the stop 448 and in FIG. 30, the second shoulder 440 abuts against the stop 448.

The spring 450 furnishes or supplies a back pull against cable 446. Also, the stop 448, with the shoulder 438 of the pulley 436, restricts the open position of the butterfly valve 430 and the stop 448, in conjunction with the shoulder 440, restricts the closed position of the butterfly valve 430.

In FIG. 33, it is seen that the butterfly valve 430 has a narrow leading edge 461 and a thicker trailing edge 462. The effect of the trailing edge 462, in comparison with the narrow leading edge, means that there is more turbulence on the trailing edge 462 and therefore a reduction in pressure which assists in keeping the butterfly valve 430 in an open position and also keeps the butterfly valve 430 in an open position with a minimum of flutter.

In FIGS. 1, 5, 29, 30 and 35, there is illustrated a positioning means for the cable 446. In FIGS. 35 and 57 there is illustrated the pulley 426. The pulley 426 is mounted on a shaft 428. There is a pivot pin or a cap nut 460 positioned on top of the shaft 428 for maintaining the pulley 426 on the shaft. In the pivot pin 460 there is a passageway 463. The cable 446 passes through the passageway 463 in the pivot pin 460. In this manner, the cable 446 is positioned centrally on the upper part of the housing 396.

In FIGS. 25–28, there is illustrated a control unit 470. For the control unit 470, there is an underlying base 472. There is mounted on the base 472 a housing 474. The housing 474 has an open bottom and an upwardly slanting rear wall 476, an upright front wall 478, an inwardly directed wall 480, and an upwardly inclined wall 482. The upwardly inclined wall 482 and the rear wall 476, along with the side walls 484, converge to form a barrel 486.

On the upper part of the rear wall 476, there is a recess 488. The upper part of the inner surface of rear wall 476 includes a flat part 490. The recess 488 is in the flat part 490 and also in the rear wall 476. The finish on the flat part 490 is smooth as this flat part can function as a bearing surface.

There is a handle 492 comprising a control shaft 494 and a gripping means 496.

Another view of the control unit 470 is illustrated in FIG. 2.

The handle 492 comprises a control shaft 494 and machined into the inner end of control shaft 494 is a throttle cam 498 having a concave portion 500. Also, as part of the handle 492, there is a smaller subshaft 502. In the smaller subshaft 502, there is a pin 504 in a hole. The pin 504 can be pressed fit or driven into the slot in the subshaft 502.

There is a spool 506 positioned on the subshaft 502. The spool 506 has a slot 508. The pin 504 fits into the slot 508. It is to be realized that the spool 506 can move rectilinearily on the subshaft 502 and also move with respect to the pin 504. However, with the rotation of the subshaft 502, the spool 506 will correspondingly rotate. The spool 506 has a first outer rim 510 and a second outer rim 512. Positioned between the two rims 510 and 512 is a smaller diameter rim 514.

In the control unit 470, there is a shaft 520 and mounted on the shaft 520 is an idler sleeve or idler gear 522. Also, there is, in the control unit 470, a shaft 524 and mounted on the shaft 524 is an idler sleeve or idler bearing 526.

Also, it is seen that in the upper part of the control unit 470 near the barrel 486 is a fixed shaft 528 and an adjacent movable shaft 530.

There is mounted on the fixed shaft 528 a reverse actuator unit 532 comprising an arm 534 and a cam 536 having a cam surface 538, which bears against the outer surface of the rim 512.

Also, there is mounted on the fixed shaft 528 a throttle actuator unit 540 having a hub portion 542 and an arm 544. The movable shaft 530 is carried by the upper part of the hub portion 542 and has an arm 546.

In the lower end of the arm 534, there is a passageway 548. Also, in the lower end of the arm 546, there is a passageway 550.

In the passageway 548, there is positioned the line 446 such as by a knot or other positioning means.

In the passageway 550, there is positioned the throttle line 552 for controlling the speed or output of the motor. In FIGS. 25–28, it is seen that the line 552 passes under the sleeve 522 or the idler pulley 522. Reverser line 446 does not come in contact with sleeve 522 or the idler pulley 522 when used in conjunction with head 624, bolt 622, and bracket 628 (et al, see FIG. 25).

There are two steering lines 554 and 556. In FIGS. 25–28, it is seen that the steering lines pass around the spool 506. In FIG. 5, it is seen that the steering lines are connected to the pulley 426.

In FIG. 57, there is illustrated the pulley 426 having a recessed area 560. Also, it is seen that there is a passageway 562 running from one recessed portion of the pulley to the other recessed portion 560 close to the hub of the pulley. The passageway 562 is of sufficient diameter to receive both the cable 554 and the cable 556. Further, there is a recessed radial passageway 564. The radial passageway 564 is a tapped passageway for receiving a set screw 566.

There is positioned in the passageway 562 the cable 554 and also the cable 556. The, the set screw 566 can be screwed into the tapped passageway 564 so as to bear against the cables 554 and 556 and to firmly position these cables in the passageway 562. In this manner, the steering lines 554 and 556 are positioned in the cord 562 or passageway 562 of the pulley 426 for controlling the steering mechanism 58.

In FIG. 25, there is an illustration of the control 84 which shows the arm 534 rotated as far counterclockwise as it can rotate so as to close the butterfly valve 430 to have the reversed thrust of the fluid flowing from the pump. In other words, the boat will move backward. Also, the throttle actuator unit is in a position so as to be wide open for the motor and pump to be operating at as full a capacity as possible. The movable shaft 530 is at the high part of the throttle cam 498 so that the throttle actuator unit 540 is illustrated in FIG. 25 to have the motor and pump operating at full capacity.

In FIG. 26, the arm 534 is rotated clockwise as far as it can rotate so that the butterfly valve 430 is open to allow the fluid from the pump and motor to drive the boat forwardly. Also, the throttle actuator unit 540 is at a high position with respect to the throttle cam 498 so that the motor is wide open and putting out as much power as it can to the pump.

In FIG. 27 the arm 534 is rotated in a clockwise direction as far as it can be rotated so that the butterfly valve 430 is in an open position and also so that the movable shaft 530 is in the small part of the throttle cam 498. The motor is hence throttled down so as to be operating at a low capacity. The butterfly valve is open and the operator of the boat can be going at a slow speed or, if fishing, trolling.

FIG. 28 is, substantially, the same as FIG. 27, but illustrates the steering lines 554 and 556, the throttle line 552, and the reverse line or lines 446 for controlling the butterfly valve 430.

In FIG. 25, there is illustrated a mounting means for the shaft 520 and the idler sleeve 522. In the inwardly directed wall 480, there is a tapped passageway 620. A bolt 622 having a head 624 is screwed into the passageway 620. On the inner end of the bolt 622 is a mounting stud 626. There is a bracket 628 having a passageway 630. The mountingstud 626 projects through the passageway 630. There is a mounting ring 632 for positioning the bracket 628 on the stud 626. The bracket 628 has a wall 634. The shaft 520 is positioned on the wall 634. As previously stated, the tension in the throttle line 552 can be varied by varying the position of the shaft 520 and idler sleeve 522, by rotating bolt 622 so that it moves inwardly, thus varying the engine speed. This allows the change of engine idle and boat speed when manueuvering slowly or trolling when fishing.

The throttle line 552 and the reverser line 446 are not in the same vertical plane but the throttle line is farther from the viewer than the reverser line 446 so that there is no possibility of entanglement and snarling of the two lines.

In FIGS. 58 and 59, there is illustrated the throttle control 470 for the motor 60. The motor 60 is an internal combustion engine such as powered by gasoline, kerosene, diesel or the like.

There is a rectangular frame 572 having a first rectangular slot 574 and a second rectangular slot 576. There is positioned in the rectangular slot 576 a portion of a housing 578 having a longitudinal recess 580. The housing 578 also has a downwardly directed finger 582. The finger 582 is positioned in the second rectangular slot 576. There is a passageway 584 connecting with the passageway 580 and passing through the end wall of the housing 578. There is positioned in the passageway 584 the control line sheath 586. The control line 552 is in the sheath 586.

Also, there is a plunger 588 having a longitudinal passageway 590. The control line 552 passes through the passageway 584 and also passes through the passageway 580 in the housing 578 and passes through the passageway 590 in the plunger 588. In the plunger 588, there is a tapped passageway 592 at right angles to the passageway 590. There is positioned in the passageway 592 a set screw 594 which can be screwed into the passageway 592 for firmly positioning the control line 552 in the housing 588.

There is positioned in the passageway 580 a spring 596. The spring 596 is positioned between the inner end of the passageway 580 in the housing 578 and the inner end of the plunger 588. Naturally, the spring 596 tends to force the plunger 588 out of the passageway 580.

The control 570 comprises a shaft 598. The shaft 598 has affixed thereto, on the upper part, an arm 600. The arm 600 has a passageway 602. There is a governor linkage 604 having a passageway aligned with the passageway 602 in the arm 600.

There is a spring 606 wrapped around the upper part of the shaft 598 and which spring has a downwardly directed finger 608. The finger 608 projects through the passageway 602 in the arm 600 and also the passageway in the arm 604 so as to attach together the arms 600 and the governor linkage 604. Further, the spring 606 wraps around the upper part of the shaft 598 and has an outwardly directed arm 610.

It is seen in FIGS. 58 and 59 that the plunger 588 has a downwardly directed arm 612. The outwardly directed arm 610 of the spring 606 bears against the inner surface of the downwardly directed arm 612 so as to further urge the plunger 588 out of the passageway 580.

On the lower part of the shaft 598 is a butterfly valve 614 in a passageway 616 in the carburetor for the motor 60.

With the operation of the throttle line 552, the butterfly valve 614 can be controlled so as to assist in controlling the fuel to the motor 60 and also the governor linkage 604 can be actuated. In effect, a harmonious balance is achieved through the operation of the spring 606. In this manner the speed of operation of the motor 60 can be controlled by the throttle line 552 and the control units 570 acting in conjunction with the butterfly valve 614 and also the governor linkage 604.

An objective in the design of the control unit 570 was to operate within the governor limits for the motor 60.

In FIGS. 42, 43 and 44, there are various views of the boat 92 with 42 being a plan view of the boat with the fisherman 638 sitting on a seat 640 and with his left foot under another seat 642. The fisherman in his left hand has a fishing pole 644 and his right hand is positioned on the control unit 84. In FIG. 42, there is illustrated the relative position of the control unit 84, the motor 60, the output heat exchanger pipe 62 in the expansion chamber 64, the input heat exchanger pipe 63, the exhaust pipe 72, and the nozzle head 380. Also, there is illustrated the housing 396 and the pulley 426.

In FIG. 43, a longitudinal, vertical cross-sectional view of the boat 92, there is illustrated the thwarts 640 and 642, the control unit 84, the motor 60, the input to heat exchanger 63, the expansion chamber 64, the exhaust pipe 72, the boot 78, the housing 396, and the pulley 426.

In FIG. 44, there is an underneath plan view illustrating the heat exchanger 52, the recess 148, the opening 158 into the pump, the bottom of the heat exchanger 144, the boot 78, a discharge hole 645 in the boot 78, a discharge tube 394, and the housing 396.

In FIGS. 38–41, there is illustrated a modification of the discharge tube 394 and a discharge housing 650. It is seen that the angle of cutoff for the discharge tube 394 is about a 45° angle sloping downwardly and outwardly. There is a discharge housing 650 which fits over the end of the tube 394 and slopes upwardly and inwardly from the lower part at an angle of about 45°. There is an upper pin 652 connecting the discharge housing 650 and the discharge tube 394 and around which pin the housing 650 can rotate. Also, there is a pin boss 654 between the housing 650 and the tube 394. Further, there is a lower pin 656 positioned between the discharge housing 650 and the discharge tube 394. A pin boss 658 is positioned between the discharge housing 650 and the discharge tube 394 and also allows the housing 650 to rotate with respect to the tube 394. The pin bosses 654 and 658 are bearing surfaces finished normal to the rotational axis of pins 652 and 656.

In FIG. 39, there is a rear elevational view looking at the stern 659 of a boat 660. The discharge tube 650 is directed straight backwards from the stern 659.

In FIG. 40, there is illustrated the discharge tube 650 pointed toward the port side of the boat 660 and directing the discharge fluid toward the port side so that the boat will turn to port.

In FIG. 41, there is illustrated a view with the discharge tube 650 directed to starboard side with the discharge fluid being so directed as to turn the boat to the starboard.

In FIGS. 40 and 41, there is illustrated an indicator 662 which indicates the center of buoyancy of the boat.

The advantage of the structure illustrated in FIGS. 38–41 is that the discharge of fluid through the discharge housing 650 increases the yaw of the boat as there is a torquing effect from the discharge fluid, through the discharge housing 650, around the center of buoyancy. Further, there is an increase of turning efficiency as it is possible to turn the boat 660 in a smaller radius using the discharge housing 650 and the discharge tube 394 as compared with a propeller on an outboard motor or a propeller on a propeller shaft on an inboard motor.

Further, with the discharge housing 650 and discharge tube 394 there is, substantially, no drag. With the structure of FIGS. 38 through 41, there is a tendency of the fluid, as it is discharged through the discharge housing 650, to lift the stern of the boat out of the water and to direct the bow of the boat into the water so that there is a greater efficiency upon turning. As the pin angle is brought to a lesser angle, a lower magnitude torquing effect is realized, reducing the tendency to drop the bow of the boat and set the inside chine when turning. Hence, lower pin 652 and 656 angles would be desirable on slow, narrow beam hulls while a larger pin 652 and 656 angle would be desirable on wide beam, high speed, planning hulls.

In FIG. 45, there is an isometric view of the cover plate 190 of FIG. 8.

In FIG. 46, there is an isometric view of the cover plate 198 of FIG. 10.

In FIG. 47, there is a side elevational view of the pump 56. There is illustrated the mounting boss 110 and the spring rod 129, also illustrated in FIG. 11. Further, there is illustrated the upper casing hub 222 and the drive shaft 226, in phantom. Also, there is the drive shaft expanded housing 272. In the upper right part of FIG. 47, there is illustrated the nipple 336 which connects with the exhaust line from the motor. And, there is illustrated an angle 364 in plenum chamber 76.

In FIG. 48, there is illustrated a heat exchanger 670 which is similar to the heat exchanger 52 illustrated in FIG. 7. There is a recess 148 for allowing cooling water to flow over the cover plate 164. Further, there are outlet passageways 184 to the rear of the cover plate 164. There is no passageway leading from the rear of the cover plate to the input passageway 156 as in the heat exchanger 52 of FIG. 7. The cooling water, after leaving the cover plate 164, exits, only, by means of the passageways 184 and does not exit by flowing into the input passageway 156.

In FIG. 49, there is illustrated a heat exchanger 680 having an input recess 148 and a cover plate 164.

In back of the cover plate 164 and in the top part of the heat exchanger 680, there is a triangular shaped recess 682. The recess 682 leads into a funnel or throat 684. The funnel or throat 684 connects with the input passageway 156 to the impeller. A contrast of the heat exchanger 680 with the heat exchanger 670 or the heat exchanger 52 shows that the heat exchanger 680 does not have exits for the cooling water at the sides of the heat exchanger but that the cooling water, after leaving the cover plate 164, is directed to the input passageway 156 to the impeller.

A contrast of the heat exchanger 670 and the heat exchanger 52 shows that the heat exchanger 52 has side exits for the cooling water after leaving the cover plate 164 and also has a central exit for the cooling water and which central exit leads to the input passageway to the impeller 156. The heat exchanger 670 has only side exits for the cooling water after leaving the cover plate 164.

In FIGS. 53–56, there is illustrated a modification of the heat exchange system for the motor and the base of the propulsion unit. In FIG. 7, there is illustrated a forward heat exchanger for the base 90 of the propulsion unit 50. In FIG. 53, there is illustrated a base propulsion unit 690 having both forward and rearward heat exchangers. The forward heat exchanger of the base propulsion unit 690 is the same as in the base 90. Therefore, the same reference numerals will be used. In FIGS. 53, 54 and 56, it is seen that rearwardly of the input passageway 156 there is a cavity 692. In this cavity 692 are a series of interleaved baffles 694 and 696.

A cover plate 698 covers the cavity 692, see FIG. 54. The cover plate 698 has a series of baffles 700. Also, there are two nipples 702 and 704 which allow hot water from the motor 60 to circulate in the cavity 692 and around the baffles 694 and 696 and also to exit from said cavity. Also, as an optional system, it is possible to circulate the oil from the engine through the cavity 692 so as to cool the oil.

In FIGS. 54 and 56, it is seen that there are a plurality of passageways 706 leading from the bottom of the base 690 and through the lower part of said base and up to the top of the cover plate 698 so as to allow cooling water from underneath the boat to flow over the top of the cover plate 698 and thereby cool some of the liquid in the cavity 692.

In FIGS. 54 and 56, it is seen that with the cover plate 698 positioned over the cavity 692 that there is a recess 708 in the rear part and upper part of the base 690. There is a front wall 710 and two side walls 712 and a rear wall 714 surrounding said recess 708. In the rear wall 714, there is a break defining passage 716. It is seen that in the middle of said passage 716 there is a standoff, or support, member 718.

The reader is to realize that the same type of cover plates illustrated in FIGS. 8 and 10 can be used for covering the cavity 692. In FIG. 54, there is illustrated only one form of cover plate 698 but other forms of cover plates and other cross-sectional forms of cover plate can be used.

In FIG. 55, there is a schematic illustration of the front heat exchanger in the base 690 and the rear heat exchanger in the base 690. The rear heat exchanger in the base 690 is referred to by reference numeral 720. In FIG. 55, it is seen that there is a motor 60, a front heat exchanger 52 and a rear heat exchanger 720. A pipe 63 connects the motor 60 with the front heat exchanger 52. A connecting pipe or passageway 722 connects the front heat exchanger 52 with the rear heat exchanger 720. A pipe 62 connects the rear heat exchanger 720 with the motor 60. There is an expansion chamber 64 connecting with the pipe 62. There is a drain pipe 724 connecting with the front heat exchanger 52 and a drain valve 726 on the drain pipe 724. Also, there is a drain pipe 728 connecting with the rear heat exchanger 720 and there is a drain valve 730 connecting with the drain pipe 728.

In FIGS. 50 and 51, there is illustrated the impeller drive shaft, the impeller, and the connections for the muffler/heat exchanger apparatus shown in FIGS. 1 and 21. Also, there is illustrated the drive shaft 226 for driving the impeller. In FIG. 51, there is illustrated the upper casing hub 222 for receiving the drive shaft 226. Also, there is a recess 250 for seals. There are two seals 731 and 732 around the drive shaft 226 and in the recess 250. Also, there is a pressure relief passageway 734 in the upper casing hub 22, which passageway 734 connects with the recess 250 for the seals. The seals 731 and 732 are to prevent water flowing to the interior of the boat from the area around the impeller. The lower seal 731 prevents a large amount of the water from flowing around the drive shaft 226 and into the interior of the boat. The pressure relief passageway 734 acts as a bleed-off for water which does get by the lower seal 730 and also prevents the creation of large pressure on the upper seal 732. The upper seal 732 also assists in preventing water working around the drive shaft 226 and into the interior of the boat. Further, the seals 731 and 732 decrease and almost eliminate water working around the drive shaft 226 and coming in contact with the bearing 258. It is essential to prevent water coming into contact with the bearing 258 so as not to harm and damage and rust the bearing.

What is claimed is:

1. A combination of a boat and a boat propelling means, with a motor having a motor drive shaft, said combination comprising:

an impeller housing having a hollow chamber therein, said housing being adapted to fit into the bottom of the boat, wherein said housing includes inlet and outlet passageways which communicate with said hollow chamber;

a heat exchanger located beneath the bottom of the boat for cooling motor fluid, a portion of said heat exchanger being in contact with said impeller housing, said heat exchanger having an opening therethrough which connects with the inlet passageway in said impeller housing, so as to allow fluid to enter into said hollow chamber;

an impeller mounted in said hollow chamber in such a manner that, when said impeller is rotated, fluid entering the inlet passageway in said impeller housing is forced through said outlet passageway, thereby resulting in propulsion of the boat; and coupling means transmitting the rotation of the motor drive shaft to said impeller.

2. The combination of claim 1, wherein said heat exchanger has a first cavity therein, and wherein said heat exchanger includes a first cover plate for said first cavity and a plurality of cooling fins located in said first cavity, said first cover plate being recessed with respect to the surrounding upper surface of said heat exchanger and having openings therein which permit a flow of fluid from the motor through said first cavity and back to the motor, said heat exchanger further having a fluid inlet located forward of said first cavity and communicating with said first cover plate, and a fluid outlet located rearward of said first cavity, wherein in operation fluid enters said fluid inlet, flows over said first cover plate between said first cover plate and the bottom of the boat, and then exits through said fluid outlet, thereby cooling the fluid flowing through said first cavity from the motor.

3. The combination of claim 2, wherein said fluid outlet of said heat exchanger communicates with one of the following: (1) the exterior of said heat exchanger, and (2) the inlet passageway in said impeller housing.

4. The combination of claim 2, wherein said fluid outlet of said heat exchanger communicates with both the exterior of said heat exchanger and the inlet passageway in said impeller housing.

5. The combination of claim 2, wherein said heat exchanger has a second cavity defined therein, and wherein said heat exchanger includes a second cover plate for said second cavity and a plurality of cooling fins located in said second cavity and wherein said second cover plate includes openings therein which permit a flow of fluid from the motor or said first cavity through said second cavity and back to the motor.

6. The combination of claim 1, including a muffler/-heat exchanger, which comprises first and second elongated tubes, said first tube being slightly smaller in diameter than said second tube and supported within said second tube in such a manner that there exists a space between said first and second tubes, and wherein said muffler/heat exchanger further includes first connecting means connecting said first tube to the exhaust outlet of the motor and second connecting means connecting said space between said first and second tubes to the hollow chamber in said impeller housing, such that the action of the impeller drives fluid throughout said space.

7. The combination of claim 6, wherein said muffler/-heat exchanger includes a reasonance chamber having an intake port and outlet port, and third connecting means connecting said first tube to said intake port, and wherein said first tube includes an opening therein in the vicinity of said third connecting means, so that fluid driven into said space by the action of the impeller is introduced into said reasonance chamber along with the exhaust from the motor.

8. The combination of claim 7, including means for selectively partially closing said opening in the first tube.

9. The combination of claim 1, wherein said coupling means includes a generally T shaped member which is rotatably positioned in a central hub portion of said impeller housing, wherein the depending portion of the T-shaped member is threaded about its free end, so that said impeller may be threaded thereon, and wherein the cross portion of said T-shaped member includes a recess for receiving a mating drive member attached to the motor drive shaft.

10. The combination of claim 9, wherein said coupling means includes a bearing for supporting said T-shaped member in the central hub of the impeller housing, so as to permit rotational movement of said coupling means therein, and wherein said coupling means further includes a pair of water-tight seals surrounding, and in intimate contact with, the depending portion of said T-shaped member, producing a water-tight fit between said coupling means and said impeller housing.

11. The combination of claim 10, wherein said coupling means further includes a fluid relief channel which connects the interface between said pair of seals and the exterior of said impeller housing.

12. The combination of claim 1, including a tube-like fluid exit means channeling the flow of fluid forced from the outlet passageway in said impeller housing to the rear of the boat, and a propulsion housing, which is adapted to be connected to said fluid exit means, said propulsion housing including an inlet port permitting fluid from said fluid exit means to enter said propulsion housing, and at least two outlet ports, a first outlet port being oriented relative to the boat such that when fluid is ejected therefrom, a forward movement of the boat is produced, and a second outlet port being oriented relative to the boat such that when fluid is ejected therefrom, a reverse movement of the boat is produced, and wherein said propulsion housing includes valve means selectively connecting said inlet port with one of said first and second outlet ports, wherein said second outlet port is further oriented relative to the boat and the inlet passageway to said impeller housing that the stream of fluid ejected from said second outlet port is directed away from the inlet passageway to said impeller housing, thereby significantly reducing the possibility of a vortex being created in the fluid in the vicinity of the inlet passageway to said impeller housing when the boat is in a reverse mode.

13. The combination of claim 12, including means for channeling the stream of fluid ejected from said second outlet port to near the forward end of the boat.

14. The combination of claim 1, including means for steering the boat and controlling the operation of the motor, comprising: a control shaft mounted for in and out movement and for rotational movement; first means on said control shaft for receiving a steering line connected to a boat steering assembly, wherein when the steering line is operatively connected to said receiving means, the boat may be steered by rotation of said shaft; a motor control lever mounted in a predetermined relationship with said control shaft and further mounted to be rotatable about a fixed point, said motor control lever including means for receiving a motor control line, wherein when the motor control line is operatively connected to said motor control lever, rotation of said motor control lever results in a change in motor speed; and second means mounted on said control shaft to mate with a portion of said motor control lever, said second means having such a contour that in and out movement of said control shaft results in a rotation of said motor control lever and hence a corresponding change in motor speed.

15. The combination of claim 14, including a boat direction reversing lever, mounted in a predetermined mating relationship with said control shaft and further mounted so as to be rotatable about said fixed point, wherein when said boat reversing lever is in a first rotational position, due to said control shaft being in a first position, the boat moves in the forward direction, and when said boat direction lever is in a second rotational position, which is spaced apart rotationally from said first rotational position, due to said control shaft being in a second position, the boat moves in the reverse direction.

16. The combination of claim 1, including a plurality of motor mount means positioned between a first mounting surface on the motor and a second mounting surface on the impeller housing for reducing motor vibration, wherein each motor mount means includes: a first portion, secured between said first and second mounting surfaces, constructed to significantly reduce motor vibrations over a first frequency range; a second portion, secured between said first and second mounting surfaces, constructed to significantly reduce motor vibrations over a second frequency range which is different than said first frequency range; and a third portion which is secured only to said first mounting surface, extending therefrom to within a distance of said second mounting surface which is small compared to the distance between said first and second mounting surfaces, wherein said third member is constructed to be substantially nondeformable.

17. The combination of claim 16, wherein said first and second portions comprise hard rubber having substantially different durometer ratings and wherein said third portion comprises a material which is substantially non-deformable.

18. The combination of claim 17, wherein said second portion has a durometer rating equal to approximately one-half ±30% of the durometer rating of said first portion.

19. The combination of claim 18, wherein said first, second and third portions are separate elements, and wherein the space between adjacent elements is relatively small compared to their size.

20. Combined control means for steering a vehicle and controlling the operation of a motor, comprising:

a control shaft mounted for in and out movement and for rotational movement;

first means on said control shaft for receiving a steering line connected to a vehicle steering assembly, wherein when the steering line is operatively connected to said receiving means, the vehicle may be steered by rotation of said shaft;

a motor control lever mounted in a predetermined relationship with said control shaft and further mounted to be rotatable about a fixed point, said motor control lever including means for receiving a motor control line, wherein when the motor control line is operatively connected to said motor control lever, rotation of said motor control lever results in a change in motor speed; and second means mounted on said control shaft to mate with a portion of said motor control lever, said second means having such a contour that in and out movement of said control shaft results in a rotation of said motor control lever and hence a corresponding change in motor speed.

21. The combination of claim 20, including a vehicle direction reversing lever, mounted in a predetermined mating relationship with said control shaft and further mounted so as to be rotatable about said fixed point, wherein when said vehicle reversing lever is in a first rotational position, due to said control shaft being in a first position, the vehicle moves in the forward direction, and when said vehicle direction lever is in a second rotational position, spaced apart rotationally from said first rotational position, due to said control shaft being in a second position, the vehicle moves in the reverse direction.

* * * * *